US011705634B2

(12) United States Patent
Hasan Abadi et al.

(10) Patent No.: US 11,705,634 B2
(45) **Date of Patent: *Jul. 18, 2023**

(54) SINGLE-LAYER WIDE ANGLE IMPEDANCE MATCHING (WAIM)

(71) Applicant: Kymeta Corporation, Redmond, WA (US)

(72) Inventors: Seyed Mohamad Amin Momeni Hasan Abadi, Redmond, WA (US); Mohsen Sazegar, Kirkland, WA (US)

(73) Assignee: Kymeta Corporation, Redmond, WA (US)

( * ) Notice: Subject to any disclaimer, the term of this patent is extended or adjusted under 35 U.S.C. 154(b) by 4 days.

This patent is subject to a terminal disclaimer.

(21) Appl. No.: 17/322,602

(22) Filed: May 17, 2021

(65) Prior Publication Data

US 2021/0367341 A1 Nov. 25, 2021

Related U.S. Application Data

(60) Provisional application No. 63/027,190, filed on May 19, 2020.

(51) Int. Cl.

| | |
|---|---|
| ***H01Q 5/335*** | (2015.01) |
| ***H01Q 1/52*** | (2006.01) |
| ***H01Q 9/04*** | (2006.01) |
| ***H01Q 21/06*** | (2006.01) |

(52) U.S. Cl.

CPC ..... *H01Q 5/335* (2015.01); *H01Q 1/523* (2013.01); *H01Q 9/0407* (2013.01); *H01Q 21/065* (2013.01)

(58) Field of Classification Search

CPC ..... H01Q 5/335; H01Q 11/14; H01Q 9/0407; H01Q 21/06; H01Q 21/061; H01Q 21/065; H01Q 15/0086

See application file for complete search history.

(56) References Cited

U.S. PATENT DOCUMENTS

| | | | | |
|---|---|---|---|---|
| 7,893,867 | B2 * | 2/2011 | Navarro | G01S 7/006 342/175 |
| 9,343,816 | B2 * | 5/2016 | Lee | H01Q 21/065 |
| 9,437,929 | B2 * | 9/2016 | Isom | H03H 7/42 |
| 10,700,429 | B2 * | 6/2020 | Mehdipour | H01Q 5/335 |

(Continued)

FOREIGN PATENT DOCUMENTS

EP 3570375 A1 11/2019

OTHER PUBLICATIONS

International Search Report and Written Opinion on the Patentability of Application No. PCT/US2021/033267 dated Sep. 17, 2021, 12 pages.

(Continued)

*Primary Examiner* — Jason Crawford

(74) *Attorney, Agent, or Firm* — Womble Bond Dickinson (US) LLP

(57) ABSTRACT

A single-layer Wide Angle Impedance Matching (WAIM) and method for using the same are described. In one embodiment, the antenna comprises: an aperture having a plurality of antenna elements operable to radiating radio-frequency (RF) energy; and a single-layer wide angle impedance matching (WAIM) structure coupled to the aperture to provide impedance matching between the antenna aperture and free space.

18 Claims, 14 Drawing Sheets

FIG. 1B

(56) References Cited

U.S. PATENT DOCUMENTS

| | | | | |
|---|---|---|---|---|
| 10,756,445 | B2 * | 8/2020 | Chen | H01Q 21/245 |
| 11,322,843 | B2 * | 5/2022 | Medhipour | H01Q 21/065 |
| 2004/0017322 | A1 * | 1/2004 | Bostwick | H01Q 13/18 343/772 |
| 2010/0073232 | A1 * | 3/2010 | Sajuyigbe | H01Q 15/006 342/372 |
| 2010/0194640 | A1 * | 8/2010 | Navarro | H01Q 21/061 342/372 |
| 2012/0200474 | A1 * | 8/2012 | Sabielny | H01Q 19/023 343/879 |
| 2017/0237181 | A1 * | 8/2017 | Chen | H01Q 21/0025 343/702 |
| 2018/0076521 | A1 * | 3/2018 | Mehdipour | H01Q 21/0012 |
| 2019/0081411 | A1 * | 3/2019 | Isom | H01Q 1/48 |
| 2019/0115664 | A1 * | 4/2019 | Veihl | H01Q 5/50 |
| 2019/0356058 | A1 * | 11/2019 | Martin | H01Q 15/006 |
| 2020/0006865 | A1 * | 1/2020 | Adada | H01Q 13/02 |
| 2021/0367341 | A1 * | 11/2021 | Hasan Abadi | H01Q 15/0086 |
| 2022/0209387 | A1 * | 6/2022 | Steward | H01Q 1/24 |

OTHER PUBLICATIONS

International Preliminary Report and Written Opinion on the Patentability of Application No. PCT/US2021/033267 dated Dec. 1, 2022, 8 pages.

* cited by examiner

Iris L2

Iris L1

Patch and Iris L1

Top View

SINGLE-LAYER WIDE ANGLE IMPEDANCE MATCHING (WAIM)

PRIORITY

The present application claims the benefit under 35 USC 119(e) of U.S. Provisional Patent Application No. 63/027,190, filed on May 19, 2020 and entitled "SINGLE-LAYER WIDE ANGLE IMPEDANCE MATCHING (WAIM)", which is incorporated by reference in its entirety.

FIELD OF THE INVENTION

Embodiments of the present invention relate to the field of satellite communications; more particularly, embodiments of the present invention relate to wide angle impedance matching (WAIM) structures used in a satellite antenna.

BACKGROUND

Antenna gain is one of the most important parameters for satellite communications systems since it determines the network coverage and speed. More specifically, more gain means better coverage and higher speed which is critical in the competitive satellite market. The antenna gain over the receive (Rx) band can be critical because, on the satellite side, the receive power at the antenna is very low. This becomes even more critical at scan angles for flat-panel electronically scanned antennas due to the increased attenuation and lower antenna gain at these angles compared to broadside case, making a higher gain value a vital parameter to close the link between the antenna and the satellite. Over the transmit (Tx) band, the gain is also important since lower gain means more power needs to be supplied to the antenna to achieve the desired signal strength, which means more cost, higher temperature, higher thermal noise, etc.

One type of antenna used in satellite communications is a radial aperture slot array antenna. Recently, there has been a number of improvements to the performance of such radial aperture slot array antennas. One of the parameters that limits the radiation efficiency of these antennas is the impedance mismatch between the antenna aperture and the free space. If this mismatch is higher at scan angles, this additional radiation efficiency loss results in poor scan loss. WAIM structures mitigate this issue by providing the appropriate impedance matching.

Dipole loading has been mentioned for use with radial aperture slot array antennas. This loading can improve the radiation efficiency by providing impedance matching. It can also be used for shifting the frequency response. A slot-dipole concept has also been applied to radial aperture slot array antennas to improve the directivity of the antenna, including to improve the overall return loss performance of the antenna, particularly, antennas operating at broadside.

SUMMARY

A single-layer Wide Angle Impedance Matching (WAIM) and method for using the same are described. In one embodiment, the antenna comprises: an aperture having a plurality of antenna elements operable to radiating radio-frequency (RF) energy; and a single-layer wide angle impedance matching (WAIM) structure coupled to the aperture to provide impedance matching between the antenna aperture and free space.

BRIEF DESCRIPTION OF THE DRAWINGS

The described embodiments and the advantages thereof may best be understood by reference to the following description taken in conjunction with the accompanying drawings. These drawings in no way limit any changes in form and detail that may be made to the described embodiments by one skilled in the art without departing from the spirit and scope of the described embodiments.

DETAILED DESCRIPTION

Figures 1A, 1B:
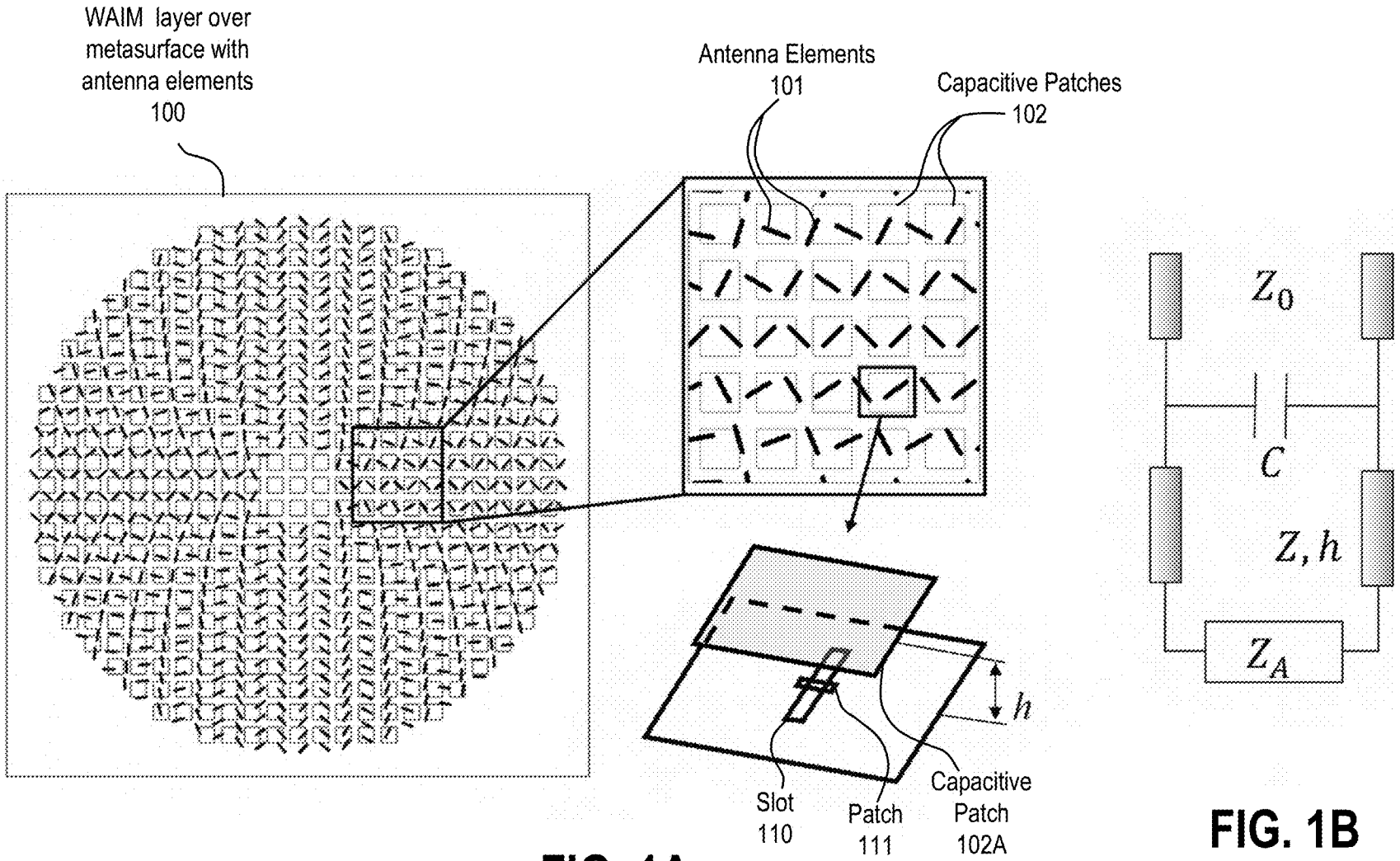
FIGS. 1A-1B illustrate one embodiment of a single-layer wide angle impedance matching (WAIM) structure.

In the following description, numerous details are set forth to provide a more thorough explanation of the present invention. It will be apparent, however, to one skilled in the art, that the present invention may be practiced without these specific details. In other instances, well-known structures and devices are shown in block diagram form, rather than in detail, in order to avoid obscuring the present invention.

A new wide-angle impedance matching (WAIM) structure for aperture antennas and method for using the same are described. The WAIM structure improves the radiation efficiency of an aperture antenna by providing appropriate impedance matching between the antenna aperture and free space. The improvement in scan loss is also due to providing better matching at scan angles. In one embodiment, the impedance matching is function of frequency, scan angle, and the polarization of the propagating wave since the antenna aperture impedance and free-space impedance vary by these parameters.

In one embodiment, the WAIM design characteristics depend on the type of the antenna aperture. In one embodiment, the antenna aperture is part of a leaky wave antenna and has sub-wavelength radiating slots. In one embodiment, the antenna aperture is a metasurface having a plurality of antenna elements that radiate radio-frequency (RF) energy. Such antenna elements can be surface scattering metamaterial antenna elements. Examples of liquid crystal (LC)-based surface scattering metamaterial antenna elements are described in more detail below. However, the antenna elements are not limited to being LC-based antenna elements. For example, in another embodiment, the antenna elements are varactor-based metamaterial antenna elements in which a varactor diode is used for tuning the radiating slot antenna element. The equivalent circuit model of a radiating surface with sub-wavelength radiating slots is a parallel resonator with a small resistive part. Therefore, the impedance curve versus frequency on a Smith chart is a circle towards the short section. In one embodiment, an L-type matching network comprising parallel capacitance and a series inductance provide the appropriate impedance matching for this configuration.

In one embodiment, the WAIM structure is single layer structure having a two-dimensional periodic array of sub-wavelength capacitive patches. In one embodiment, this structure is printed on a dielectric substrate and is separated from that aperture by a dielectric spacer (e.g., foam, etc.). One key advantage of the single layer WAIM structure described herein over the prior art is that it can be prototyped and assembled simply at a very low cost.

Embodiments of the WAIM structure have other key advantages including low-cost fabrication and simple assembly process. In one embodiment, because embodiments of the design include a single layer structure, this results in a lower fabrication cost compared to alternatives, eliminates tight tolerances on multiple physical dimensions, and reduces the complexity of the assembly process. There is also flexibility in choosing dimensions of its impedance matching elements, so they can be selected in a way to be well within the tolerances of the fabrication technology.

Furthermore, and importantly, embodiments described herein do not require any positional/rotational alignment between its impedance matching elements and the antenna aperture elements. This results in a lower cost since it eliminates positional tolerances and also simplifies the assembly process. Also since it does not rely on alignment between its impedance matching elements and the antenna elements, the design provides a very repeatable RF performance.

Moreover, the same RF performance can be achieved with a variety of pixel dimensions. This enables the possibility of using cost fabrication technologies that do not necessarily provide tight tolerances on feature dimensions. For example, in one embodiment, the WAIM structure comprises a substrate with elements that as screen-printed onto the substrate. The use of screen-printing in such a case is a very low-cost alternative to printed circuit board (PCB) technology.

Note that the single layer WAIM structure may be used with a number of different antenna apertures. Examples of aperture antennas are described in more detail below. Note though that the WAIM structure disclosed herein may be used with antenna apertures other than those described below.

In one embodiment, the single layer WAIM structure comprises an L-type impedance network that is realized by a capacitive surface separated from the aperture by a dielectric spacer. In some embodiments, the capacitive impedance surface uses a 2D array of sub-wavelength elements. The sub-wavelength elements can be one or more of many different types. Some examples are sub-wavelength patches, dipoles, split ring resonators (SRRs), etc.

FIG. 1A illustrates one embodiment of a WAIM structure. In this embodiment, single layer WAIM structure 100 is over an antenna aperture comprising a metasurface having a plurality of antenna elements 101. In one embodiment, antenna elements 101 comprise slot resonators (e.g., surface scattering metamaterial antenna elements, RF radiating antenna elements, etc.). WAIM structure 100 comprises a two-dimensional (2D) array of sub-wavelength square-shaped patches 102. In one embodiment, patches 102 are sub-wavelength patches to ensure this structure, which is a metasurface, acts as a capacitive layer. In one embodiment, patches 102 are capacitive patches. In one embodiment, patches 102 are printed on a substrate. In one embodiment, WAIM structure 100 is separated from the aperture by a dielectric spacer or foam.

The WAIM structure can be modeled using an equivalent circuit model shown in FIG. 1B. Referring to the model in FIG. 1B, capacitive patches 102 are modeled by a parallel capacitance and the spacer between aperture and patches 102 is modeled with a short section of the transmission line.

There are several reasons that this type of single-layer WAIM structure is desired. First, there is flexibility in choosing the physical parameters to achieve the same performance. The intrinsic capacitance of this surface is a function of physical dimensions of the patches and the its surrounding medium. Equation (1) shows the first order approximation formula to calculate this capacitance value for a normal incident wave:

$$C = \varepsilon_0 \varepsilon_{r_{eff}} \frac{2D}{\pi} \ln\left(\frac{1}{\sin\frac{\pi s}{2D}}\right) \tag{1}$$

For more information on this formula, see Luukkonen et. al., "Simple and accurate analytical model of planar grids and high-impedance surfaces comprising metal strips or patches", IEEE Transactions on Antennas and Propagation, vol. 56, no. 6, pp. 1623-1632, June 2008. In this equation, s is the gap-spacing between adjacent patches and D is the periodicity. This equation shows that the same capacitance can be achieved by many sets of gap-spacing and the periodicity as long as they are much smaller than the wavelength. This is important since it allows choosing the parameters according to the fabrication method tolerances.

Second, the impedance of this surface is independent of the scan plane (i.e. phi) of the antenna. This is due to 90-degree rotational symmetry of the structure and the fact that the intrinsic capacitance is formed by the electric field between parallel edges of the adjacent patches. This feature is desired in certain antennas that have an aperture that is rotationally symmetric.

Third, in one embodiment, the surface impedance of the WAIM structure is a function of scan angle and polarization of the propagating wave. If appropriately designed, the WAIM structure provides the impedance matching between the antenna aperture and the free space impedance for both orthogonal polarizations (i.e. TE and TM) for a variety of scan angles.

Fourth, in one embodiment, the WAIM structure is very wideband. Therefore, it can potentially provide impedance matching for apertures that have wideband radiating elements or have multiple radiating elements at different frequencies. This feature is important in certain antennas where the aperture is populated by multiple radiating elements.

One embodiment of a design procedure for embodiments of the WAIM structure is based on its equivalent circuit model shown in FIG. 1B. In this model, all parameters are functions of scan angle and polarization of the wave. Equations (2) and (3) show how the transmission line impedance changes as a function of scan angle and polarization ($\eta_0$ is free space impedance at broadside). These equations are also valid for the free space.

$$Z_{TE}=\eta_0/\cos(\theta) \tag{2}$$

$$Z_{TM}=\eta_0\cos(\theta) \tag{3}$$

Eqs. (4) and (5) shows how the capacitance vary for the orthogonal polarizations as a function of scan angle. $C_0$ is the capacitance at broadside.

$$C_{TE} = C_0\left(1-\frac{\sin(\theta)^2}{2}\right) \tag{4}$$

$$C_{TM} = C_0 \tag{5}$$

Assuming the properties of the dielectric substrate are pre-defined, key parameters in the design are the thickness of the foam and the capacitance value $C_0$. These values are defined in a way that the design provides the desired impedance matching in all scans and for both Transverse Electric (TE) and Transverse Magnetic (TM) polarizations. This is a general solution since any other polarization can be decomposed into these two orthogonal polarizations.

Next, the selected parameters in the equivalent circuit model are mapped to the physical parameters. Note that h is simply the thickness of the dielectric spacer (e.g., foam, dielectric laminates, polyester, polycarbonate, glass, honeycomb spacer etc.). The capacitance is mapped to the patch dimension and periodicity using Eq (1).

Note that in one embodiment, the single-layer WAIM structure is attached to the dielectric spacer using adhesive. In one embodiment, the dielectric spacer is attached to the antenna aperture using adhesive. In one embodiment, the height of the dielectric layer is 60 mil. Alternatively, the dielectric layer can be other sizes (e.g., 1.5 mm). In alternative embodiments, the single-layer WAIM structure, dielectric layer and antenna layer are not attached together but contact each other. In such a case, other antenna components (e.g., a radome) holds these components in place.

In one embodiment, the single-layer WAIM in fabricated on top of the dielectric layer. In one embodiment, the single-layer WAIM is screen printed onto the dielectric layer. This reduces the two layers to one layer.

Figure 2A:
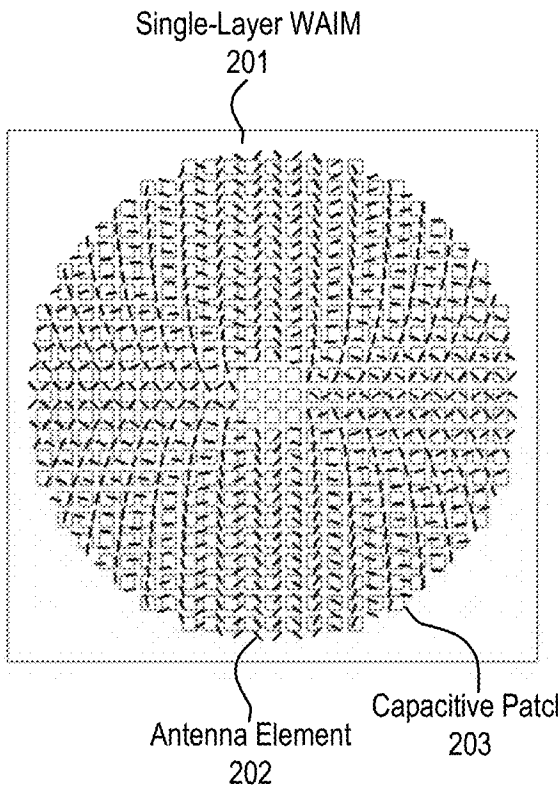
FIGS. 2A-2C illustrate an alternative installation of a WAIM structure on an aperture with various alignments.
Figure 2B:
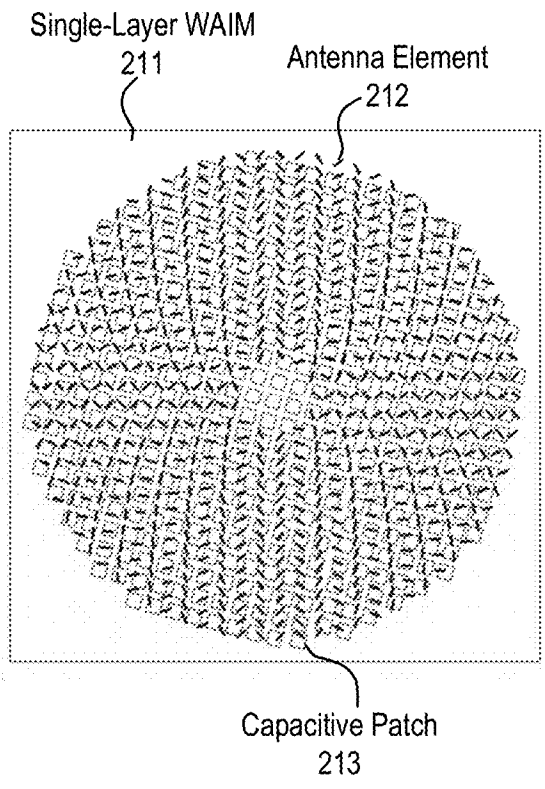
Figure 2C:
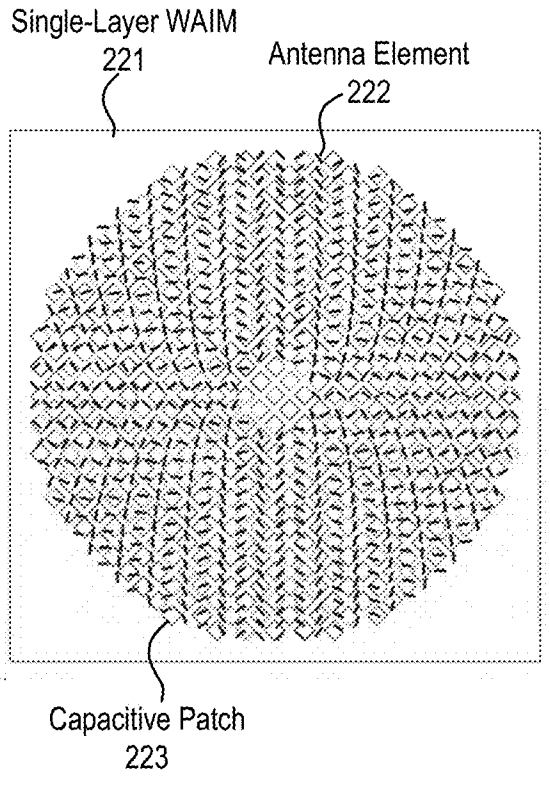

There are a number of advantages associated with embodiments of the WAIM structure disclosed herein. For example, as mentioned above, the proposed design does not require any positional/rotational alignment. FIGS. 2A-2C illustrate an alternative installation of WAIM on aperture with various alignments. In this case, the WAIM structure in each of these embodiments includes square capacitive patches that are the same size.

Referring to FIG. 2A, single-layer WAIM structure 201 comprises a 2D array of capacitive patches 203 over an aperture having antenna elements 202. Patches 203 in the 2D array are squares that are patterned across the array aligned in horizontal and vertical directions. Referring to FIG. 2B, single-layer WAIM structure 211 comprises a 2D array of capacitive patches 213 over an aperture having antenna elements 212. The 2D array in FIG. 2B is the same as that of FIG. 2A except it is rotated 22.5°. Referring to FIG. 2C, single-layer WAIM structure 221 comprises a 2D array of capacitive patches 223 over an aperture having antenna elements 222. The 2D array in FIG. 2C is the same as that of FIG. 2A except it is rotated 45° (22.5° with respect to the 2D array in FIG. 2B).

Figures 2D, 2E, 2F:
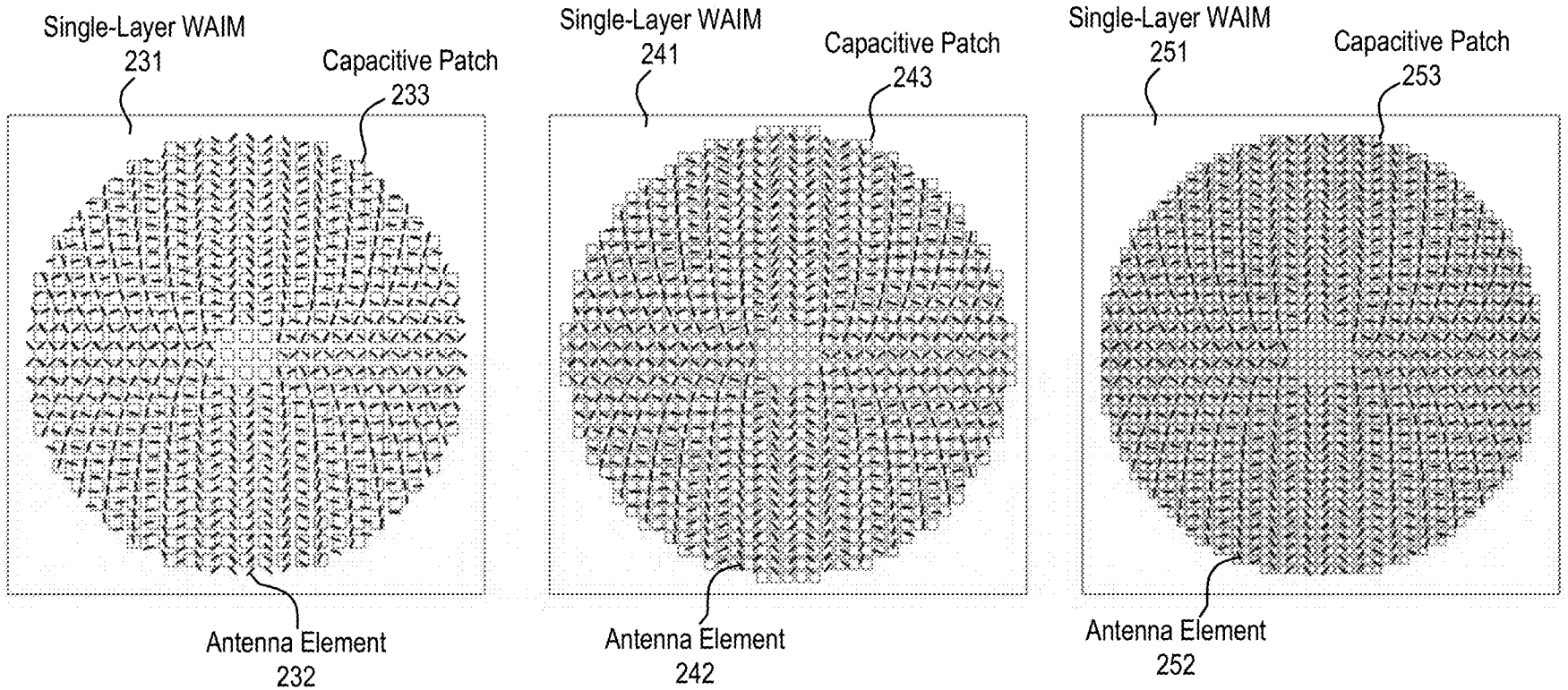
FIG. 2D-2F illustrate flexibility on achieving the same performance using a variety of feature dimensions.

Also, as discussed, the same performance can be achieved using a 2D array of capacitive patches with different patch width and periodicity. FIG. 2D-2F illustrate examples of single-layer WAIM structures that achieve the same performance using a variety of feature dimensions. Referring to FIG. 2D, single-layer WAIM structure 231 comprises a 2D array of capacitive patches 233 over an aperture having antenna elements 232. Patches 233 in the 2D array are square-shaped and patterned across the array aligned in horizontal and vertical directions. Referring to FIG. 2E, single-layer WAIM structure 241 comprises a 2D array of capacitive patches 243 over an aperture having antenna elements 242. However, the size of the patches in the 2D array in FIG. 2E is smaller than the patches of FIG. 2A. Referring to FIG. 2F, single-layer WAIM structure 251 comprises a 2D array of capacitive patches 253 over an aperture having antenna elements 252. In this case, the size of the patches in the 2D array in FIG. 2F is smaller than the patches of FIG. 2E (and therefore is smaller than the patches in FIG. 2D.

In one embodiment, the capacitive patches are metal (e.g., copper, silver, etc.) on a substrate (e.g., printed circuit board (PCB) (e.g., FR4, etc.), polycarbonate, glass, etc.). In one embodiment, when screen printing the patches, the substrate comprise polyester. The patches may be a variety of thickness. In one embodiment, the thickness of the patches is 17 um, 35 um, etc. In one embodiment, each of the square patches is 200 mil by 200 mil. However, as discussed above, other sizes may be used (e.g., 250 mil×250 mil, etc.).

Figure 3:
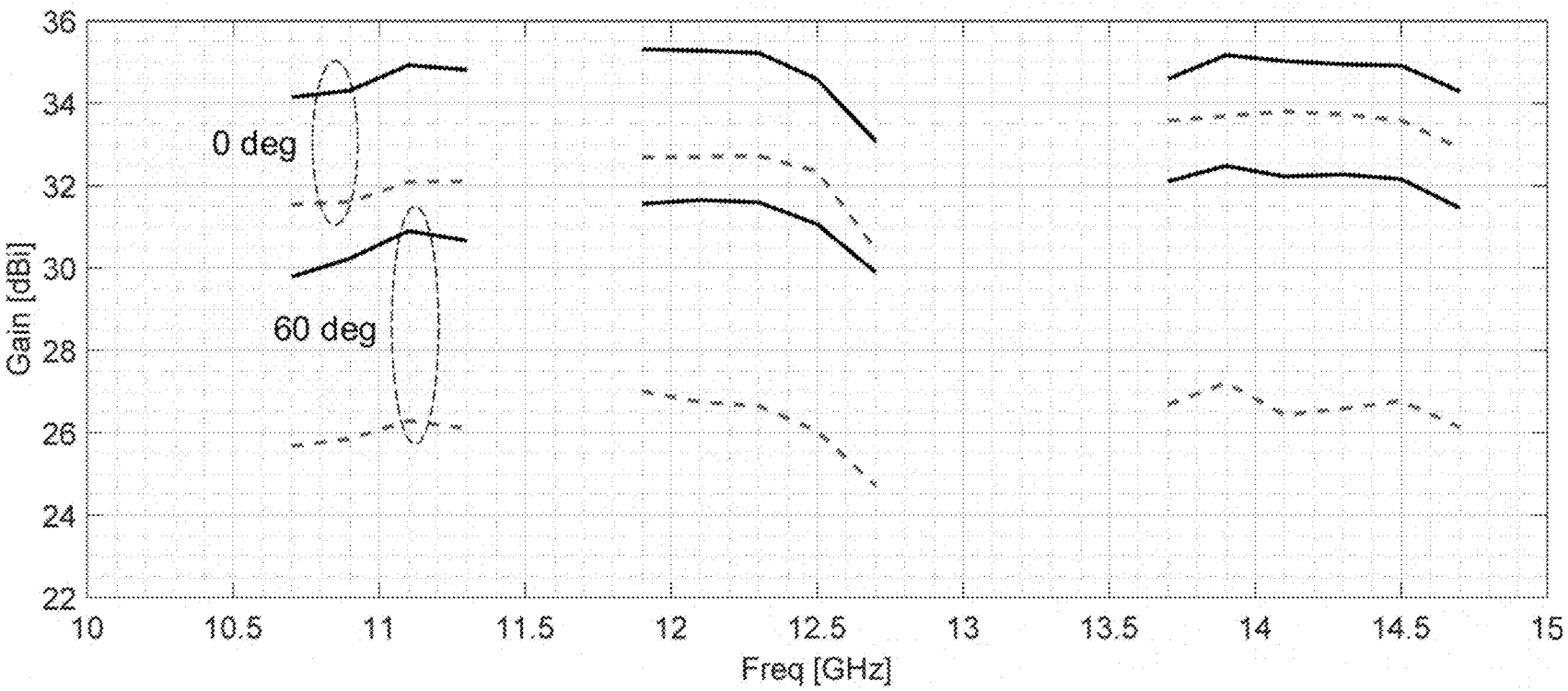
FIG. 3 illustrates gain and scan loss improvement for one embodiment of a single-layer WAIM structure.

The WAIM embodiments disclosed herein improve the radiation efficiency by providing appropriate impedance matching between the antenna aperture and the free space. The radiation efficiency improvement results in antenna gain improvement. FIG. 3 shows gain measurements at broadside and 60 deg at TE plane (H-pol) on an example antenna aperture. Referring to FIG. 3, the test results are shown at three sub-bands. Dashed lines show the measurement without the WAIM structure and the solid lines show the gain when the WAIM structure is installed. Significant improvement was observed when the WAIM structure is installed both at broadside and scan. Since the gain improvement is more significant than broadside, the scan loss is also greatly improved.

Figure 4:
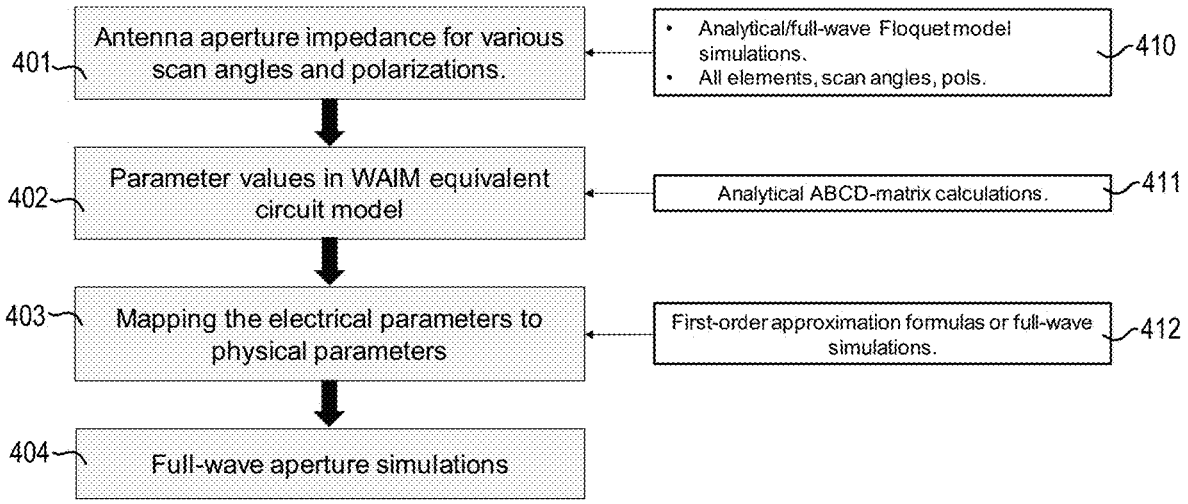
FIG. 4 is a flow diagram of one embodiment of a process for designing a single-layer WAIM structure.

FIG. 4 is a flow diagram of one embodiment of a process for designing a single-layer WAIM structure. Referring to FIG. 4, the process begins by determining the antenna aperture impedance for various scan angles and polarizations (processing block 401). In one embodiment, this is performed using analytical and full-wave Floquet model simulations and is performed using inputs comprising all antenna elements (e.g., all receiving and transmitting radiating elements on an aperture), scan angles and polarizations (410).

Once the antenna aperture impedance for various scan angles and polarizations has been determined, processing logic inputs the parameter values into a WAIM equivalent circuit model (processing block 402). In one embodiment, the inputs to the model include the results of performing analytical ABCD-matrix calculations (411). The output are the circuit model electrical parameters. In one embodiment, these outputs include the length of the transmission line and the capacitance value in the equivalent circuit model.

Processing logic then maps the electrical parameters to physical parameters (processing block 403). In one embodiment, this is done using first order approximation formulas or full-wave simulations in a manner well-known in the art (412). Once the mapping is complete, processing logic performs full-wave aperture simulations on the design (processing block 404).

There are a number of alternative embodiments. For example, the WAIM structure disclosed herein may be used with any antenna aperture with arrays of sub-wavelength radiating elements. Furthermore, the same element geometry can be expanded to WAIM structures having multiple layers as an impedance matching network.

Figure 5A:
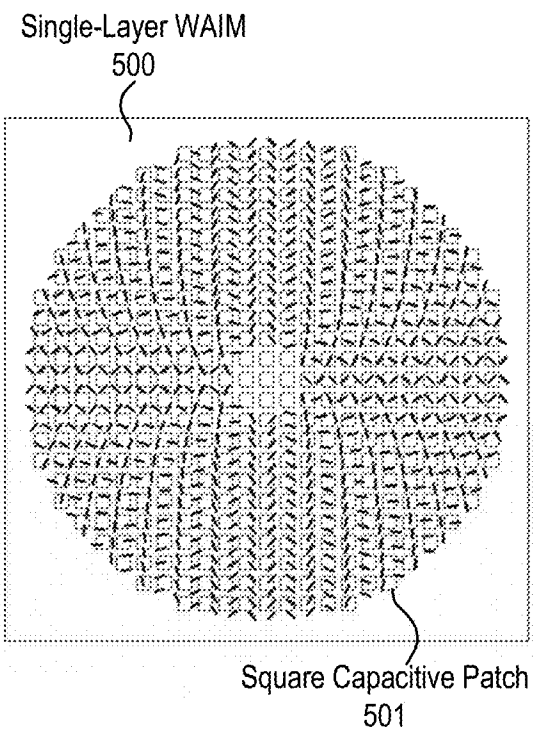
FIGS. 5A-C illustrate alternative capacitive surfaces for use in WAIM structures.
Figure 5B:
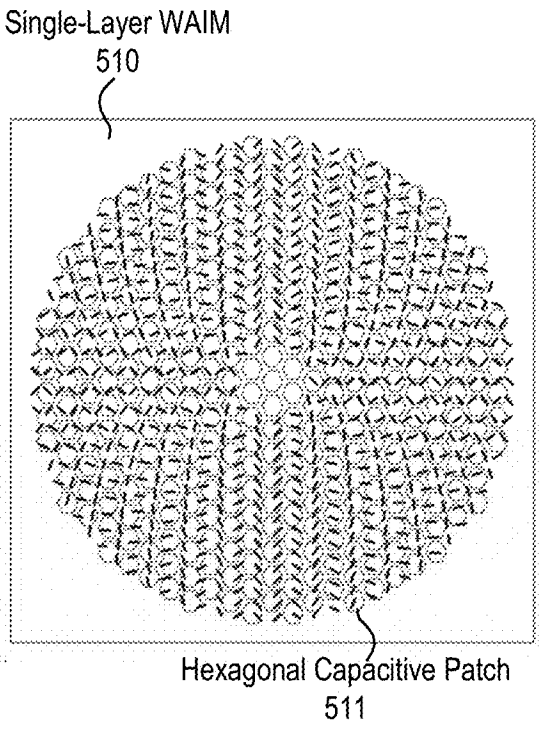
Figure 5C:
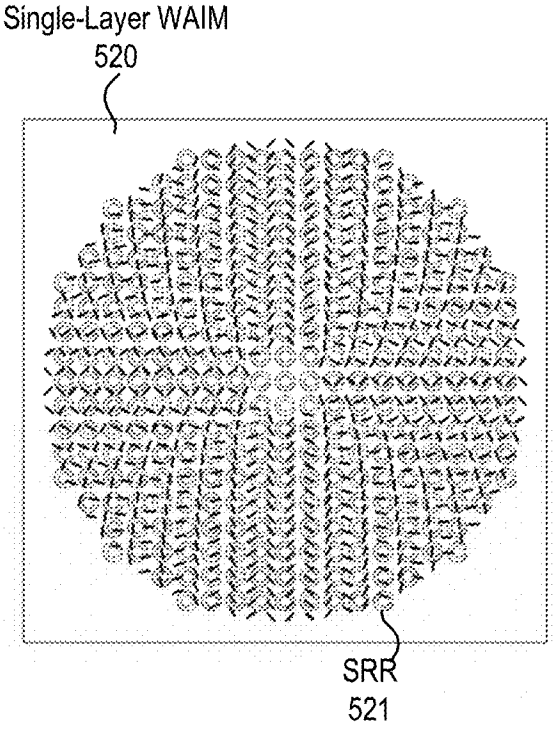

Also, as discussed above, the capacitive surface can be implemented using a 2D array of a variety of sub-wavelength elements. FIGS. 5A-5C illustrates examples of WAIM structures with alternative configurations. Referring to FIG. 5A, single-layer WAIM structure 500 includes a 2D pattern of square-shaped capacitive patches 501. Referring to FIG. 5B, single-layer WAIM structure 510 includes a 2D pattern of hexagonally-shaped capacitive patches 511. Referring to FIG. 5C, single-layer WAIM structure 520 includes a 2D pattern of split-ring resonators (SSRs) 521. Other shapes of capacitive elements may be used as well.

Examples of Antenna Systems

In one embodiment, the flat panel antenna is part of a metamaterial antenna system. Embodiments of a metamaterial antenna system for communications satellite earth stations are described. In one embodiment, the antenna system is a component or subsystem of a satellite earth station (ES) operating on a mobile platform (e.g., aeronautical, maritime, land, etc.) that operates using either Ka-band frequencies or Ku-band frequencies for civil commercial satellite communications. Note that embodiments of the antenna system also can be used in earth stations that are not on mobile platforms (e.g., fixed or transportable earth stations).

In one embodiment, the antenna system uses surface scattering metamaterial technology to form and steer transmit and receive beams through separate antennas.

In one embodiment, the antenna system is comprised of three functional subsystems: (1) a wave guiding structure consisting of a cylindrical wave feed architecture; (2) an array of wave scattering metamaterial unit cells that are part of antenna elements; and (3) a control structure to command formation of an adjustable radiation field (beam) from the metamaterial scattering elements using holographic principles.

Antenna Elements

Figure 6:
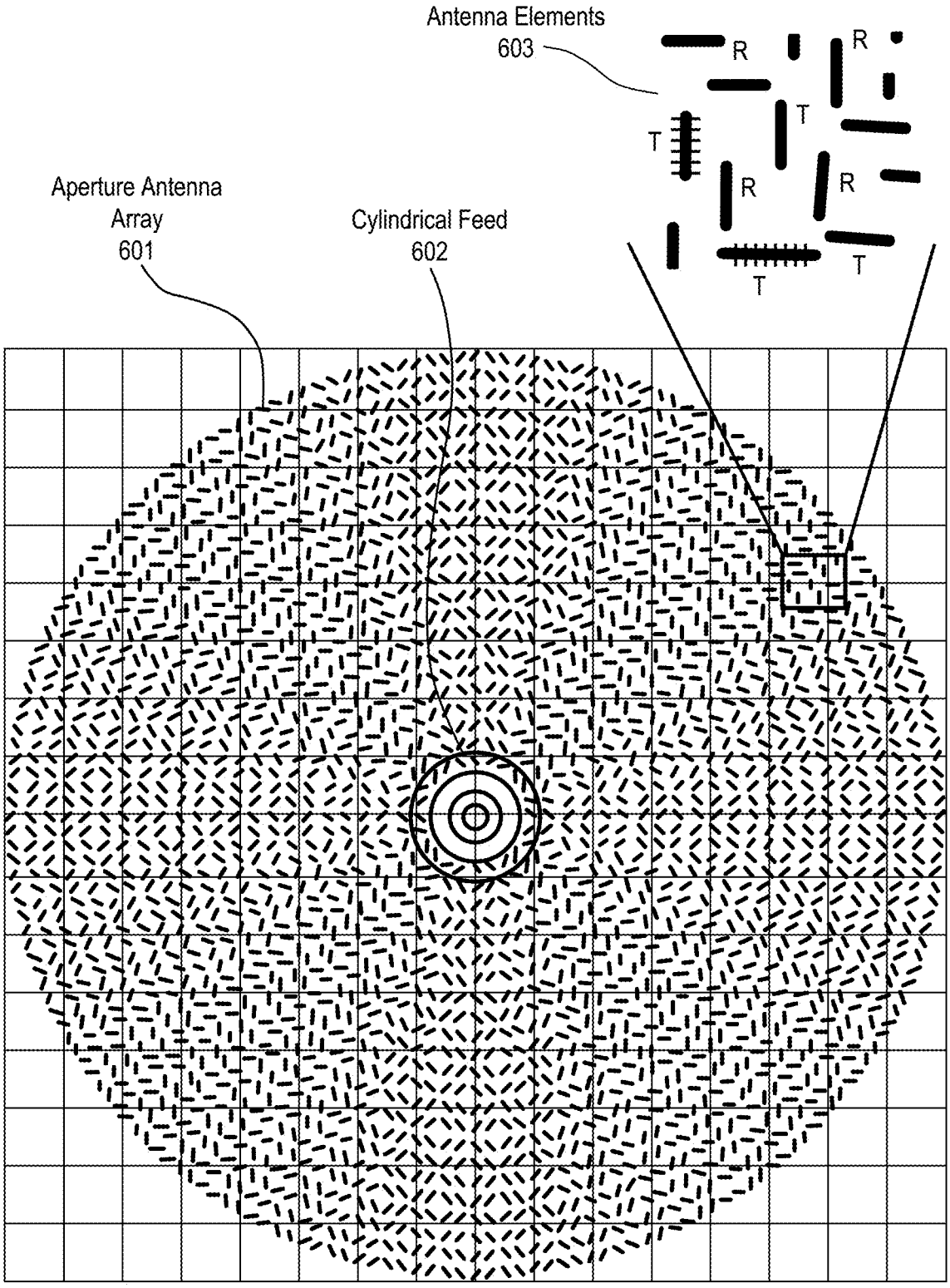
FIG. 6 illustrates an aperture having one or more arrays of antenna elements placed in concentric rings around an input feed of the cylindrically fed antenna.

FIG. 6 illustrates the schematic of one embodiment of a cylindrically fed holographic radial aperture antenna. Referring to FIG. 6, the antenna aperture has one or more arrays 601 of antenna elements 603 that are placed in concentric rings around an input feed 602 of the cylindrically fed antenna. In one embodiment, antenna elements 603 are radio frequency (RF) resonators that radiate RF energy. In one embodiment, antenna elements 603 comprise both Rx and Tx irises that are interleaved and distributed on the whole surface of the antenna aperture. Examples of such antenna elements are described in greater detail below. Note that the RF resonators described herein may be used in antennas that do not include a cylindrical feed.

In one embodiment, the antenna includes a coaxial feed that is used to provide a cylindrical wave feed via input feed 602. In one embodiment, the cylindrical wave feed architecture feeds the antenna from a central point with an excitation that spreads outward in a cylindrical manner from the feed point. That is, a cylindrically fed antenna creates an outward travelling concentric feed wave. Even so, the shape of the cylindrical feed antenna around the cylindrical feed can be circular, square or any shape. In another embodiment, a cylindrically fed antenna creates an inward travelling feed wave. In such a case, the feed wave most naturally comes from a circular structure.

In one embodiment, antenna elements 603 comprise irises and the aperture antenna of FIG. 6 is used to generate a main beam shaped by using excitation from a cylindrical feed wave for radiating irises through tunable liquid crystal (LC) material. In one embodiment, the antenna can be excited to radiate a horizontally or vertically polarized electric field at desired scan angles.

In one embodiment, the antenna elements comprise a group of patch antennas. This group of patch antennas comprises an array of scattering metamaterial elements. In one embodiment, each scattering element in the antenna system is part of a unit cell that consists of a lower conductor, a dielectric substrate and an upper conductor that embeds a complementary electric inductive-capacitive resonator ("complementary electric LC" or "CELC") that is etched in or deposited onto the upper conductor. As would be understood by those skilled in the art, LC in the context of CELC refers to inductance-capacitance, as opposed to liquid crystal.

In one embodiment, a liquid crystal (LC) is disposed in the gap around the scattering element. This LC is driven by the direct drive embodiments described above. In one embodiment, liquid crystal is encapsulated in each unit cell and separates the lower conductor associated with a slot from an upper conductor associated with its patch. Liquid crystal has a permittivity that is a function of the orientation of the molecules comprising the liquid crystal, and the orientation of the molecules (and thus the permittivity) can be controlled by adjusting the bias voltage across the liquid crystal. Using this property, in one embodiment, the liquid crystal integrates an on/off switch for the transmission of energy from the guided wave to the CELC. When switched on, the CELC emits an electromagnetic wave like an electrically small dipole antenna. Note that the teachings herein are not limited to having a liquid crystal that operates in a binary fashion with respect to energy transmission.

In one embodiment, the feed geometry of this antenna system allows the antenna elements to be positioned at forty-five-degree (45°) angles to the vector of the wave in the wave feed. Note that other positions may be used (e.g., at 40° angles). This position of the elements enables control of the free space wave received by or transmitted/radiated from the elements. In one embodiment, the antenna elements are arranged with an inter-element spacing that is less than a free-space wavelength of the operating frequency of the antenna. For example, if there are four scattering elements per wavelength, the elements in the 30 GHz transmit antenna will be approximately 2.5 mm (i.e., ¼th the 10 mm free-space wavelength of 30 GHz).

In one embodiment, the two sets of elements are perpendicular to each other and simultaneously have equal amplitude excitation if controlled to the same tuning state. Rotating them+/−45 degrees relative to the feed wave excitation achieves both desired features at once. Rotating one set 0 degrees and the other 90 degrees would achieve the perpendicular goal, but not the equal amplitude excitation goal.

Note that 0 and 90 degrees may be used to achieve isolation when feeding the array of antenna elements in a single structure from two sides.

The amount of radiated power from each unit cell is controlled by applying a voltage to the patch (potential across the LC channel) using a controller. Traces to each patch are used to provide the voltage to the patch antenna. The voltage is used to tune or detune the capacitance and thus the resonance frequency of individual elements to effectuate beamforming. The voltage required is dependent on the liquid crystal mixture being used. The voltage tuning characteristic of liquid crystal mixtures is mainly described by a threshold voltage at which the liquid crystal starts to be affected by the voltage and the saturation voltage, above which an increase of the voltage does not cause major tuning in liquid crystal. These two characteristic parameters can change for different liquid crystal mixtures.

In one embodiment, as discussed above, a matrix drive is used to apply voltage to the patches in order to drive each cell separately from all the other cells without having a separate connection for each cell (direct drive). Because of the high density of elements, the matrix drive is an efficient way to address each cell individually.

In one embodiment, the control structure for the antenna system has 2 main components: the antenna array controller, which includes drive electronics, for the antenna system, is below the wave scattering structure, while the matrix drive switching array is interspersed throughout the radiating RF array in such a way as to not interfere with the radiation. In one embodiment, the drive electronics for the antenna system comprise commercial off-the shelf LCD controls used in commercial television appliances that adjust the bias voltage for each scattering element by adjusting the amplitude or duty cycle of an AC bias signal to that element.

In one embodiment, the antenna array controller also contains a microprocessor executing the software. The control structure may also incorporate sensors (e.g., a GPS receiver, a three-axis compass, a 3-axis accelerometer, 3-axis gyro, 3-axis magnetometer, etc.) to provide location and orientation information to the processor. The location and orientation information may be provided to the processor by other systems in the earth station and/or may not be part of the antenna system.

More specifically, the antenna array controller controls which elements are turned off and those elements turned on and at which phase and amplitude level at the frequency of operation. The elements are selectively detuned for frequency operation by voltage application.

For transmission, a controller supplies an array of voltage signals to the RF patches to create a modulation, or control pattern. The control pattern causes the elements to be turned to different states. In one embodiment, multistate control is used in which various elements are turned on and off to varying levels, further approximating a sinusoidal control pattern, as opposed to a square wave (i.e., a sinusoid gray shade modulation pattern). In one embodiment, some elements radiate more strongly than others, rather than some elements radiate and some do not. Variable radiation is achieved by applying specific voltage levels, which adjusts the liquid crystal permittivity to varying amounts, thereby detuning elements variably and causing some elements to radiate more than others.

The generation of a focused beam by the metamaterial array of elements can be explained by the phenomenon of constructive and destructive interference. Individual electromagnetic waves sum up (constructive interference) if they have the same phase when they meet in free space and waves cancel each other (destructive interference) if they are in opposite phase when they meet in free space. If the slots in a slotted antenna are positioned so that each successive slot is positioned at a different distance from the excitation point of the guided wave, the scattered wave from that element will have a different phase than the scattered wave of the previous slot. If the slots are spaced one quarter of a guided wavelength apart, each slot will scatter a wave with a one fourth phase delay from the previous slot.

Using the array, the number of patterns of constructive and destructive interference that can be produced can be increased so that beams can be pointed theoretically in any direction plus or minus ninety degrees (90°) from the bore sight of the antenna array, using the principles of holography. Thus, by controlling which metamaterial unit cells are turned on or off (i.e., by changing the pattern of which cells are turned on and which cells are turned off), a different pattern of constructive and destructive interference can be produced, and the antenna can change the direction of the main beam. The time required to turn the unit cells on and off dictates the speed at which the beam can be switched from one location to another location.

In one embodiment, the antenna system produces one steerable beam for the uplink antenna and one steerable beam for the downlink antenna. In one embodiment, the antenna system uses metamaterial technology to receive beams and to decode signals from the satellite and to form transmit beams that are directed toward the satellite. In one embodiment, the antenna systems are analog systems, in contrast to antenna systems that employ digital signal processing to electrically form and steer beams (such as phased array antennas). In one embodiment, the antenna system is considered a "surface" antenna that is planar and relatively low profile, especially when compared to conventional satellite dish receivers.

Figure 7:
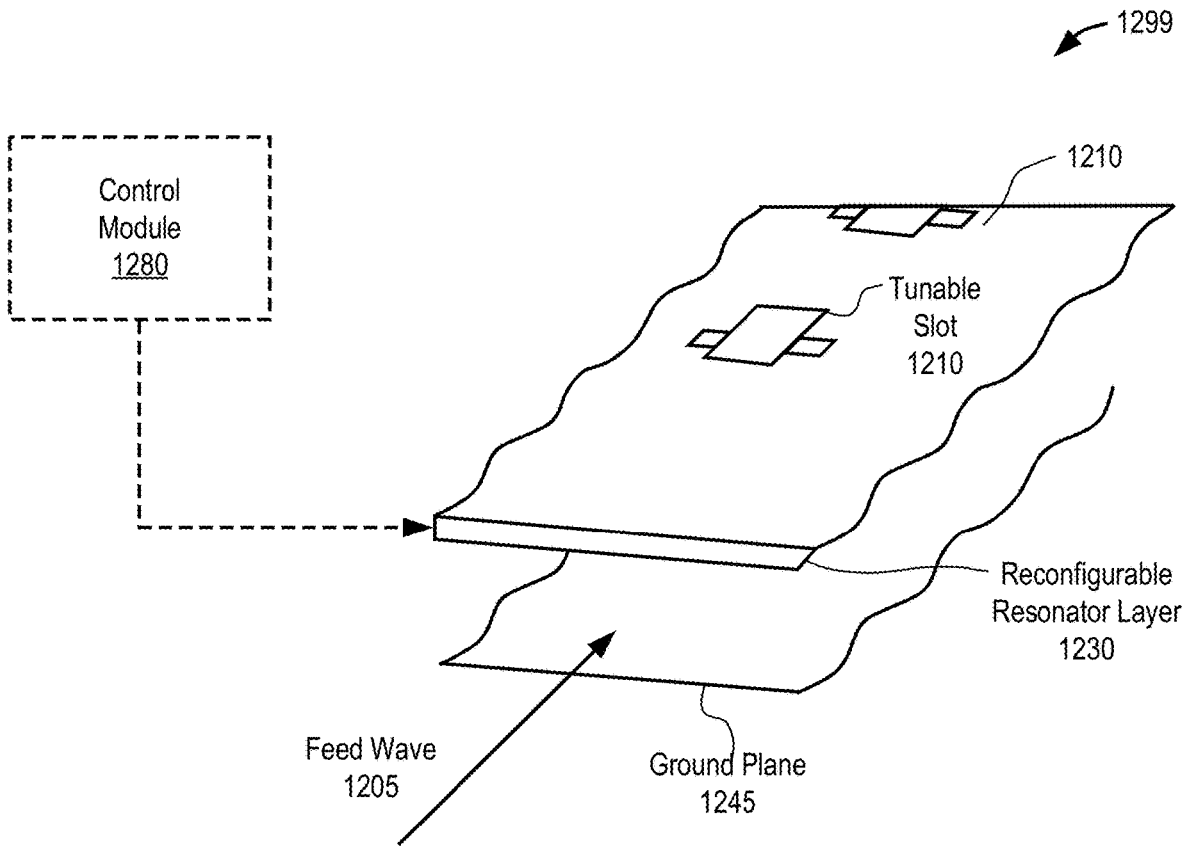
FIG. 7 illustrates a perspective view of one row of antenna elements that includes a ground plane and a reconfigurable resonator layer.

FIG. 7 illustrates a perspective view of one row of antenna elements that includes a ground plane and a reconfigurable resonator layer. Reconfigurable resonator layer 1230 includes an array of tunable slots 1210. The array of tunable slots 1210 can be configured to point the antenna in a desired direction. Each of the tunable slots can be tuned/adjusted by varying a voltage across the liquid crystal.

Figure 8A:
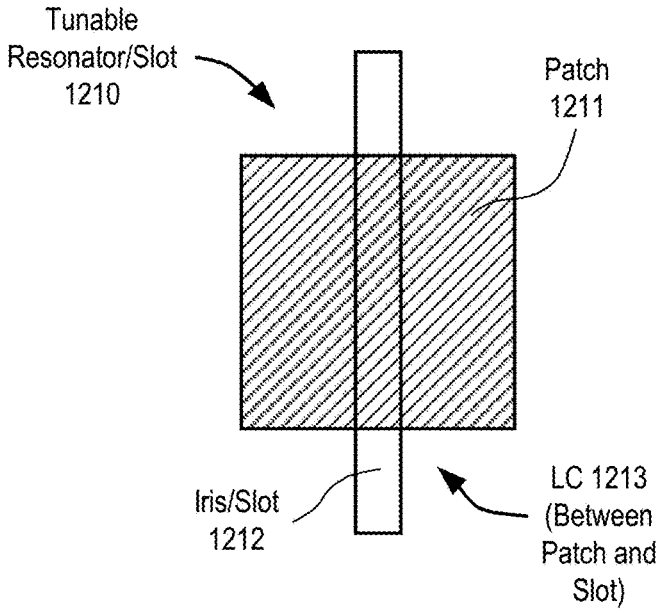
FIG. 8A illustrates one embodiment of a tunable resonator/slot.

Control module 1280 is coupled to reconfigurable resonator layer 1230 to modulate the array of tunable slots 1210 by varying the voltage across the liquid crystal in FIG. 8A. Control module 1280 may include a Field Programmable Gate Array ("FPGA"), a microprocessor, a controller, System-on-a-Chip (SoC), or other processing logic. In one embodiment, control module 1280 includes logic circuitry (e.g., multiplexer) to drive the array of tunable slots 1210. In one embodiment, control module 1280 receives data that includes specifications for a holographic diffraction pattern to be driven onto the array of tunable slots 1210. The holographic diffraction patterns may be generated in response to a spatial relationship between the antenna and a satellite so that the holographic diffraction pattern steers the downlink beams (and uplink beam if the antenna system performs transmit) in the appropriate direction for communication. Although not drawn in each Figure, a control module similar to control module 1280 may drive each array of tunable slots described in the Figures of the disclosure.

Radio Frequency ("RF") holography is also possible using analogous techniques where a desired RF beam can be generated when an RF reference beam encounters an RF holographic diffraction pattern. In the case of satellite communications, the reference beam is in the form of a feed wave, such as feed wave 1205 (approximately 20 GHz in some embodiments). To transform a feed wave into a radiated beam (either for transmitting or receiving purposes), an interference pattern is calculated between the desired RF beam (the object beam) and the feed wave (the reference beam). The interference pattern is driven onto the array of tunable slots 1210 as a diffraction pattern so that the feed wave is "steered" into the desired RF beam (having the desired shape and direction). In other words, the feed wave encountering the holographic diffraction pattern "reconstructs" the object beam, which is formed according to design requirements of the communication system. The holographic diffraction pattern contains the excitation of each element and is calculated by $w_{hologram}=w^*_{in}w_{out}$, with $w_{in}$ as the wave equation in the waveguide and $w_{out}$ the wave equation on the outgoing wave.

FIG. 8A illustrates one embodiment of a tunable resonator/slot 1210. Tunable slot 1210 includes an iris/slot 1212, a radiating patch 1211, and liquid crystal 1213 disposed between iris 1212 and patch 1211. In one embodiment, radiating patch 1211 is co-located with iris 1212.

Figure 8B:
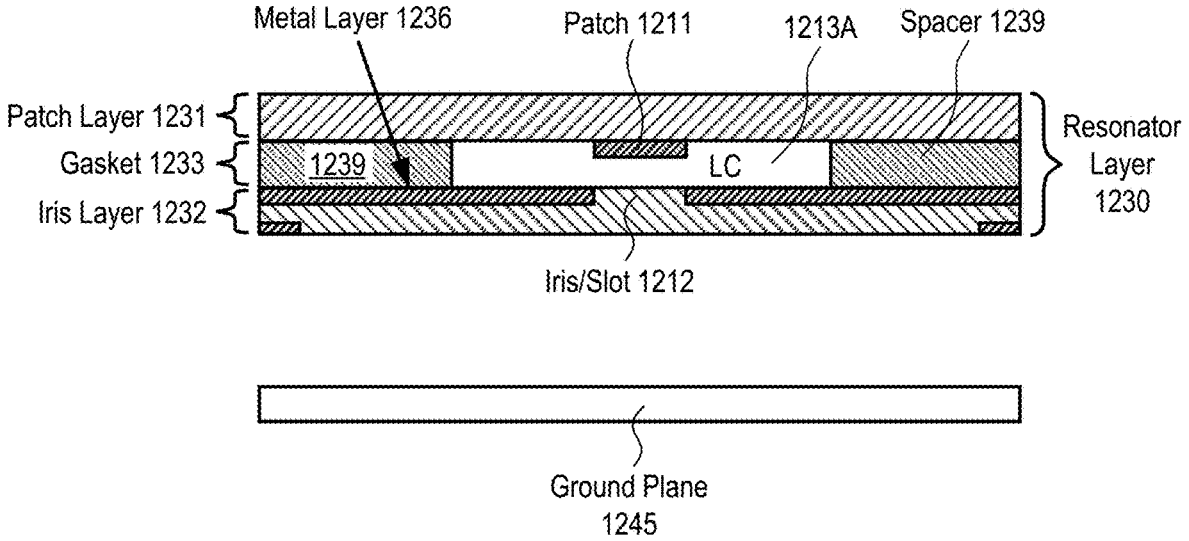
FIG. 8B illustrates a cross section view of one embodiment of a physical antenna aperture.

FIG. 8B illustrates a cross section view of one embodiment of a physical antenna aperture. The antenna aperture includes ground plane 1245, and a metal layer 1236 within iris layer 1232, which is included in reconfigurable resonator layer 1230. In one embodiment, the antenna aperture of FIG. 8B includes a plurality of tunable resonator/slots 1210 of FIG. 8A. Iris/slot 1212 is defined by openings in metal layer 1236. A feed wave, such as feed wave 1205 of FIG. 7, may have a microwave frequency compatible with satellite communication channels. The feed wave propagates between ground plane 1245 and resonator layer 1230.

Reconfigurable resonator layer 1230 also includes gasket layer 1233 and patch layer 1231. Gasket layer 1233 is disposed between patch layer 1231 and iris layer 1232. Note that in one embodiment, a spacer could replace gasket layer 1233. In one embodiment, iris layer 1232 is a printed circuit board ("PCB") that includes a copper layer as metal layer 1236. In one embodiment, iris layer 1232 is glass. Iris layer 1232 may be other types of substrates.

Openings may be etched in the copper layer to form slots 1212. In one embodiment, iris layer 1232 is conductively coupled by a conductive bonding layer to another structure (e.g., a waveguide) in FIG. 8B. Note that in an embodiment the iris layer is not conductively coupled by a conductive bonding layer and is instead interfaced with a non-conducting bonding layer.

Patch layer 1231 may also be a PCB that includes metal as radiating patches 1211. In one embodiment, gasket layer 1233 includes spacers 1239 that provide a mechanical standoff to define the dimension between metal layer 1236 and patch 1211. In one embodiment, the spacers are 75 microns, but other sizes may be used (e.g., 3-200 mm). As mentioned above, in one embodiment, the antenna aperture of FIG. 8B includes multiple tunable resonator/slots, such as tunable resonator/slot 1210 includes patch 1211, liquid crystal 1213, and iris 1212 of FIG. 8A. The chamber for liquid crystal 1213A is defined by spacers 1239, iris layer 1232 and metal layer 1236. When the chamber is filled with liquid crystal, patch layer 1231 can be laminated onto spacers 1239 to seal liquid crystal within resonator layer 1230.

A voltage between patch layer 1231 and iris layer 1232 can be modulated to tune the liquid crystal in the gap between the patch and the slots (e.g., tunable resonator/slot 1210). Adjusting the voltage across liquid crystal 1213 varies the capacitance of a slot (e.g., tunable resonator/slot 1210). Accordingly, the reactance of a slot (e.g., tunable resonator/slot 1210) can be varied by changing the capacitance. Resonant frequency of slot 1210 also changes according to the equation $$f = \frac{1}{2\pi\sqrt{LC}}$$

where f is the resonant frequency of slot 1210 and L and C are the inductance and capacitance of slot 1210, respectively. The resonant frequency of slot 1210 affects the energy radiated from feed wave 1205 propagating through the waveguide. As an example, if feed wave 1205 is 20 GHz, the resonant frequency of a slot 1210 may be adjusted (by varying the capacitance) to 17 GHz so that the slot 1210 couples substantially no energy from feed wave 1205. Or, the resonant frequency of a slot 1210 may be adjusted to 20 GHz so that the slot 1210 couples energy from feed wave 1205 and radiates that energy into free space. Although the examples given are binary (fully radiating or not radiating at all), full gray scale control of the reactance, and therefore the resonant frequency of slot 1210 is possible with voltage variance over a multi-valued range. Hence, the energy radiated from each slot 1210 can be finely controlled so that detailed holographic diffraction patterns can be formed by the array of tunable slots.

In one embodiment, tunable slots in a row are spaced from each other by λ/5. Other spacings may be used. In one embodiment, each tunable slot in a row is spaced from the closest tunable slot in an adjacent row by λ/2, and, thus, commonly oriented tunable slots in different rows are spaced by λ/4, though other spacings are possible (e.g., λ/5, λ/6.3). In another embodiment, each tunable slot in a row is spaced from the closest tunable slot in an adjacent row by λ/3.

Embodiments use reconfigurable metamaterial technology, such as described in U.S. patent application Ser. No. 14/550,178, entitled "Dynamic Polarization and Coupling Control from a Steerable Cylindrically Fed Holographic Antenna", filed Nov. 21, 2014 and U.S. patent application Ser. No. 14/610,502, entitled "Ridged Waveguide Feed Structures for Reconfigurable Antenna", filed Jan. 30, 2015.

FIGS. 9A-D illustrate one embodiment of the different layers for creating the slotted array. The antenna array includes antenna elements that are positioned in rings, such as the example rings shown in FIG. 6. Note that in this example the antenna array has two different types of antenna elements that are used for two different types of frequency bands.

Figure 9A:
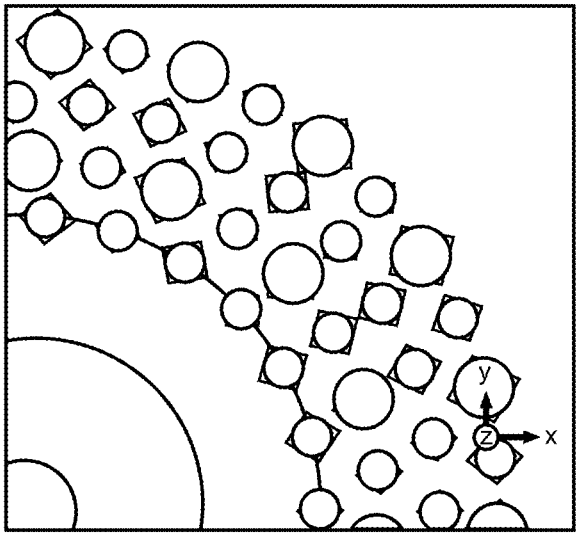
FIG. 9A illustrates a portion of the first iris board layer with locations corresponding to the slots.
Figure 9B:
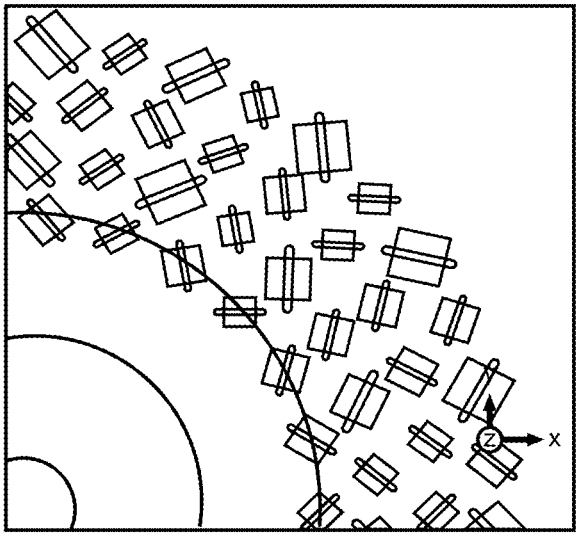
FIG. 9B illustrates a portion of the second iris board layer containing slots.
Figure 9C:
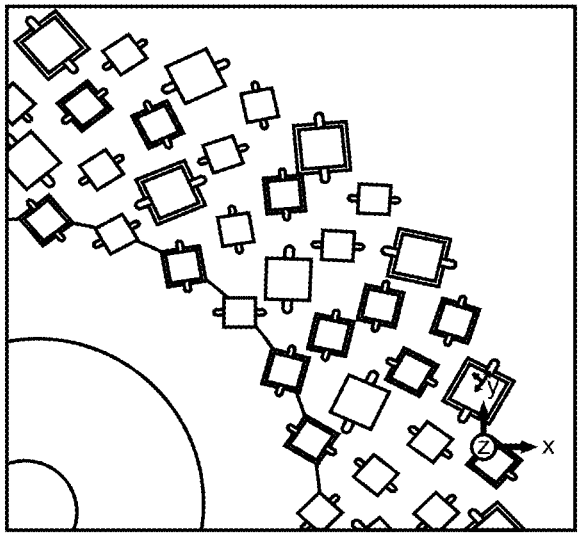
FIG. 9C illustrates patches over a portion of the second iris board layer.
Figure 9D:
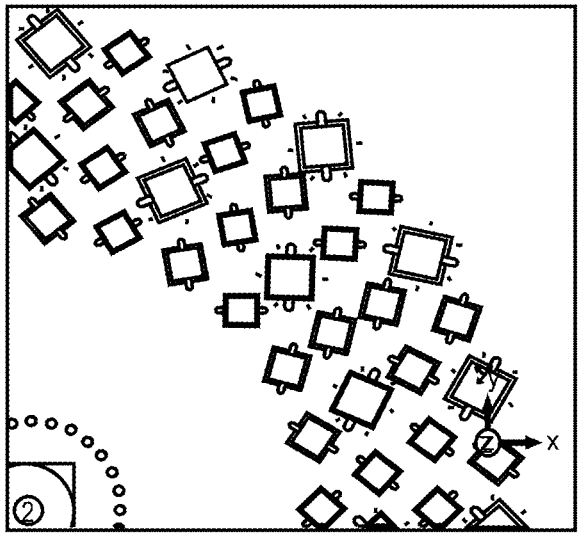
FIG. 9D illustrates a top view of a portion of the slotted array.

FIG. 9A illustrates a portion of the first iris board layer with locations corresponding to the slots. Referring to FIG. 9A, the circles are open areas/slots in the metallization in the bottom side of the iris substrate, and are for controlling the coupling of elements to the feed (the feed wave). Note that this layer is an optional layer and is not used in all designs. FIG. 9B illustrates a portion of the second iris board layer containing slots. FIG. 9C illustrates patches over a portion of the second iris board layer. FIG. 9D illustrates a top view of a portion of the slotted array.

Figure 10:
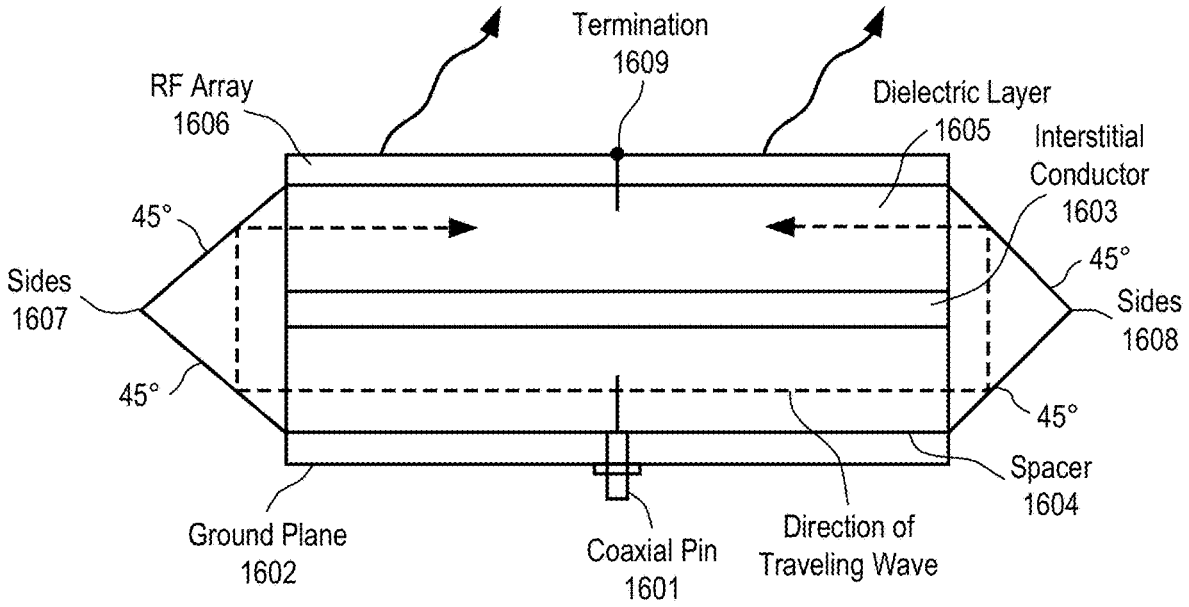
FIG. 10 illustrates a side view of one embodiment of a cylindrically fed antenna structure.

FIG. 10 illustrates a side view of one embodiment of a cylindrically fed antenna structure. The antenna produces an inwardly travelling wave using a double layer feed structure (i.e., two layers of a feed structure). In one embodiment, the antenna includes a circular outer shape, though this is not required. That is, non-circular inward travelling structures can be used. In one embodiment, the antenna structure in FIG. 10 includes a coaxial feed, such as, for example, described in U.S. Publication No. 2015/0236412, entitled "Dynamic Polarization and Coupling Control from a Steerable Cylindrically Fed Holographic Antenna", filed on Nov. 21, 2014.

Referring to FIG. 10, a coaxial pin 1601 is used to excite the field on the lower level of the antenna. In one embodiment, coaxial pin 1601 is a 50Ω coax pin that is readily available. Coaxial pin 1601 is coupled (e.g., bolted) to the bottom of the antenna structure, which is conducting ground plane 1602.

Separate from conducting ground plane 1602 is interstitial conductor 1603, which is an internal conductor. In one embodiment, conducting ground plane 1602 and interstitial conductor 1603 are parallel to each other. In one embodiment, the distance between ground plane 1602 and interstitial conductor 1603 is 0.1-0.15". In another embodiment, this distance may be λ/2, where λ is the wavelength of the travelling wave at the frequency of operation.

Ground plane 1602 is separated from interstitial conductor 1603 via a spacer 1604. In one embodiment, spacer 1604 is a foam or air-like spacer. In one embodiment, spacer 1604 comprises a plastic spacer.

On top of interstitial conductor 1603 is dielectric layer 1605. In one embodiment, dielectric layer 1605 is plastic. The purpose of dielectric layer 1605 is to slow the travelling wave relative to free space velocity. In one embodiment, dielectric layer 1605 slows the travelling wave by 30% relative to free space. In one embodiment, the range of indices of refraction that are suitable for beamforming are 1.2-1.8, where free space has by definition an index of refraction equal to 1. Other dielectric spacer materials, such as, for example, plastic, may be used to achieve this effect. Note that materials other than plastic may be used as long as they achieve the desired wave slowing effect. Alternatively, a material with distributed structures may be used as dielectric 1605, such as periodic sub-wavelength metallic structures that can be machined or lithographically defined, for example.

An RF-array 1606 is on top of dielectric 1605. In one embodiment, the distance between interstitial conductor 1603 and RF-array 1606 is 0.1-0.15". In another embodiment, this distance may be $\lambda_{eff}/2$, where λeff is the effective wavelength in the medium at the design frequency.

The antenna includes sides 1607 and 1608. Sides 1607 and 1608 are angled to cause a travelling wave feed from coax pin 1601 to be propagated from the area below interstitial conductor 1603 (the spacer layer) to the area above interstitial conductor 1603 (the dielectric layer) via reflection. In one embodiment, the angle of sides 1607 and 1608 are at 45° angles. In an alternative embodiment, sides 1607 and 1608 could be replaced with a continuous radius to achieve the reflection. While FIG. 10 shows angled sides that have angle of 45 degrees, other angles that accomplish signal transmission from lower-level feed to upper-level feed may be used. That is, given that the effective wavelength in the lower feed will generally be different than in the upper feed, some deviation from the ideal 45° angles could be used to aid transmission from the lower to the upper feed level. For example, in another embodiment, the 45° angles are replaced with a single step. The steps on one end of the antenna go around the dielectric layer, interstitial the conductor, and the spacer layer. The same two steps are at the other ends of these layers.

In operation, when a feed wave is fed in from coaxial pin 1601, the wave travels outward concentrically oriented from coaxial pin 1601 in the area between ground plane 1602 and interstitial conductor 1603. The concentrically outgoing waves are reflected by sides 1607 and 1608 and travel inwardly in the area between interstitial conductor 1603 and RF array 1606. The reflection from the edge of the circular perimeter causes the wave to remain in phase (i.e., it is an in-phase reflection). The travelling wave is slowed by dielectric layer 1605. At this point, the travelling wave starts interacting and exciting with elements in RF array 1606 to obtain the desired scattering.

To terminate the travelling wave, a termination 1609 is included in the antenna at the geometric center of the antenna. In one embodiment, termination 1609 comprises a pin termination (e.g., a 50Ω pin). In another embodiment, termination 1609 comprises an RF absorber that terminates unused energy to prevent reflections of that unused energy back through the feed structure of the antenna. These could be used at the top of RF array 1606.

Figure 11:
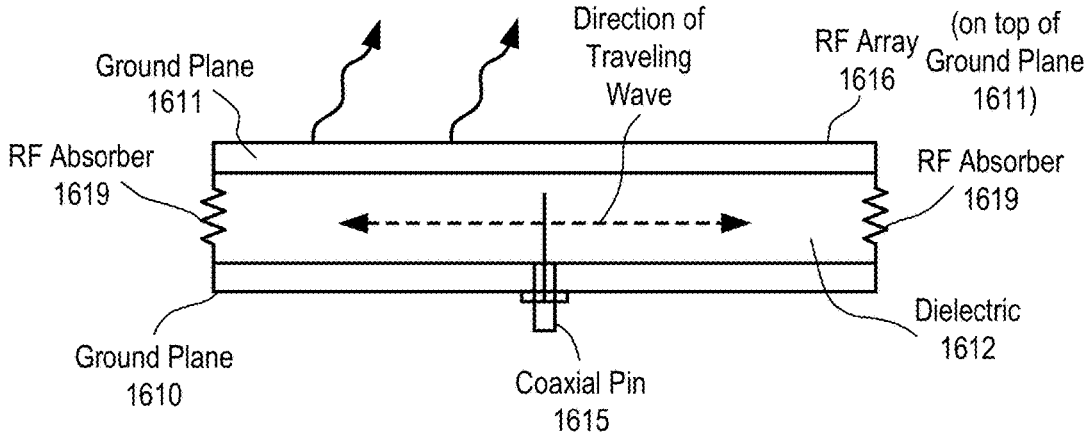
FIG. 11 illustrates another embodiment of the antenna system with an outgoing wave.

FIG. 11 illustrates another embodiment of the antenna system with an outgoing wave. Referring to FIG. 11, two ground planes 1610 and 1611 are substantially parallel to each other with a dielectric layer 1612 (e.g., a plastic layer, etc.) in between ground planes. RF absorbers 1619 (e.g., resistors) couple the two ground planes 1610 and 1611 together. A coaxial pin 1615 (e.g., 50Ω) feeds the antenna. An RF array 1616 is on top of dielectric layer 1612 and ground plane 1611.

In operation, a feed wave is fed through coaxial pin 1615 and travels concentrically outward and interacts with the elements of RF array 1616.

The cylindrical feed in both the antennas of FIGS. 10 and 11 improves the service angle of the antenna. Instead of a service angle of plus or minus forty-five degrees azimuth (±45° Az) and plus or minus twenty-five degrees elevation (±25° El), in one embodiment, the antenna system has a service angle of seventy-five degrees (75°) from the bore sight in all directions. As with any beamforming antenna comprised of many individual radiators, the overall antenna gain is dependent on the gain of the constituent elements, which themselves are angle-dependent. When using common radiating elements, the overall antenna gain typically decreases as the beam is pointed further off bore sight. At 75 degrees off bore sight, significant gain degradation of about 6 dB is expected.

Embodiments of the antenna having a cylindrical feed solve one or more problems. These include dramatically simplifying the feed structure compared to antennas fed with a corporate divider network and therefore reducing total required antenna and antenna feed volume; decreasing sensitivity to manufacturing and control errors by maintaining high beam performance with coarser controls (extending all the way to simple binary control); giving a more advantageous side lobe pattern compared to rectilinear feeds because the cylindrically oriented feed waves result in spatially diverse side lobes in the far field; and allowing polarization to be dynamic, including allowing left-hand circular, right-hand circular, and linear polarizations, while not requiring a polarizer.

Array of Wave Scattering Elements

RF array 1606 of FIG. 10 and RF array 1616 of FIG. 11 include a wave scattering subsystem that includes a group of patch antennas (i.e., scatterers) that act as radiators. This group of patch antennas comprises an array of scattering metamaterial elements.

In one embodiment, each scattering element in the antenna system is part of a unit cell that consists of a lower conductor, a dielectric substrate and an upper conductor that embeds a complementary electric inductive-capacitive resonator ("complementary electric LC" or "CELC") that is etched in or deposited onto the upper conductor.

In one embodiment, a liquid crystal (LC) is injected in the gap around the scattering element. Liquid crystal is encapsulated in each unit cell and separates the lower conductor associated with a slot from an upper conductor associated with its patch. Liquid crystal has a permittivity that is a function of the orientation of the molecules comprising the liquid crystal, and the orientation of the molecules (and thus the permittivity) can be controlled by adjusting the bias voltage across the liquid crystal. Using this property, the liquid crystal acts as an on/off switch for the transmission of energy from the guided wave to the CELC. When switched on, the CELC emits an electromagnetic wave like an electrically small dipole antenna.

Controlling the thickness of the LC increases the beam switching speed. A fifty percent (50%) reduction in the gap between the lower and the upper conductor (the thickness of the liquid crystal) results in a fourfold increase in speed. In another embodiment, the thickness of the liquid crystal results in a beam switching speed of approximately fourteen milliseconds (14 ms). In one embodiment, the LC is doped in a manner well-known in the art to improve responsiveness so that a seven millisecond (7 ms) requirement can be met.

The CELC element is responsive to a magnetic field that is applied parallel to the plane of the CELC element and perpendicular to the CELC gap complement. When a voltage is applied to the liquid crystal in the metamaterial scattering unit cell, the magnetic field component of the guided wave induces a magnetic excitation of the CELC, which, in turn, produces an electromagnetic wave in the same frequency as the guided wave.

The phase of the electromagnetic wave generated by a single CELC can be selected by the position of the CELC on the vector of the guided wave. Each cell generates a wave in phase with the guided wave parallel to the CELC. Because the CELCs are smaller than the wave length, the output wave has the same phase as the phase of the guided wave as it passes beneath the CELC.

In one embodiment, the cylindrical feed geometry of this antenna system allows the CELC elements to be positioned at forty-five-degree (45°) angles to the vector of the wave in the wave feed. This position of the elements enables control of the polarization of the free space wave generated from or received by the elements. In one embodiment, the CELCs are arranged with an inter-element spacing that is less than a free-space wavelength of the operating frequency of the antenna. For example, if there are four scattering elements per wavelength, the elements in the 30 GHz transmit antenna will be approximately 2.5 mm (i.e., ¼th the 10 mm free-space wavelength of 30 GHz).

In one embodiment, the CELCs are implemented with patch antennas that include a patch co-located over a slot with liquid crystal between the two. In this respect, the metamaterial antenna acts like a slotted (scattering) wave guide. With a slotted wave guide, the phase of the output wave depends on the location of the slot in relation to the guided wave.

Cell Placement

Figure 12:
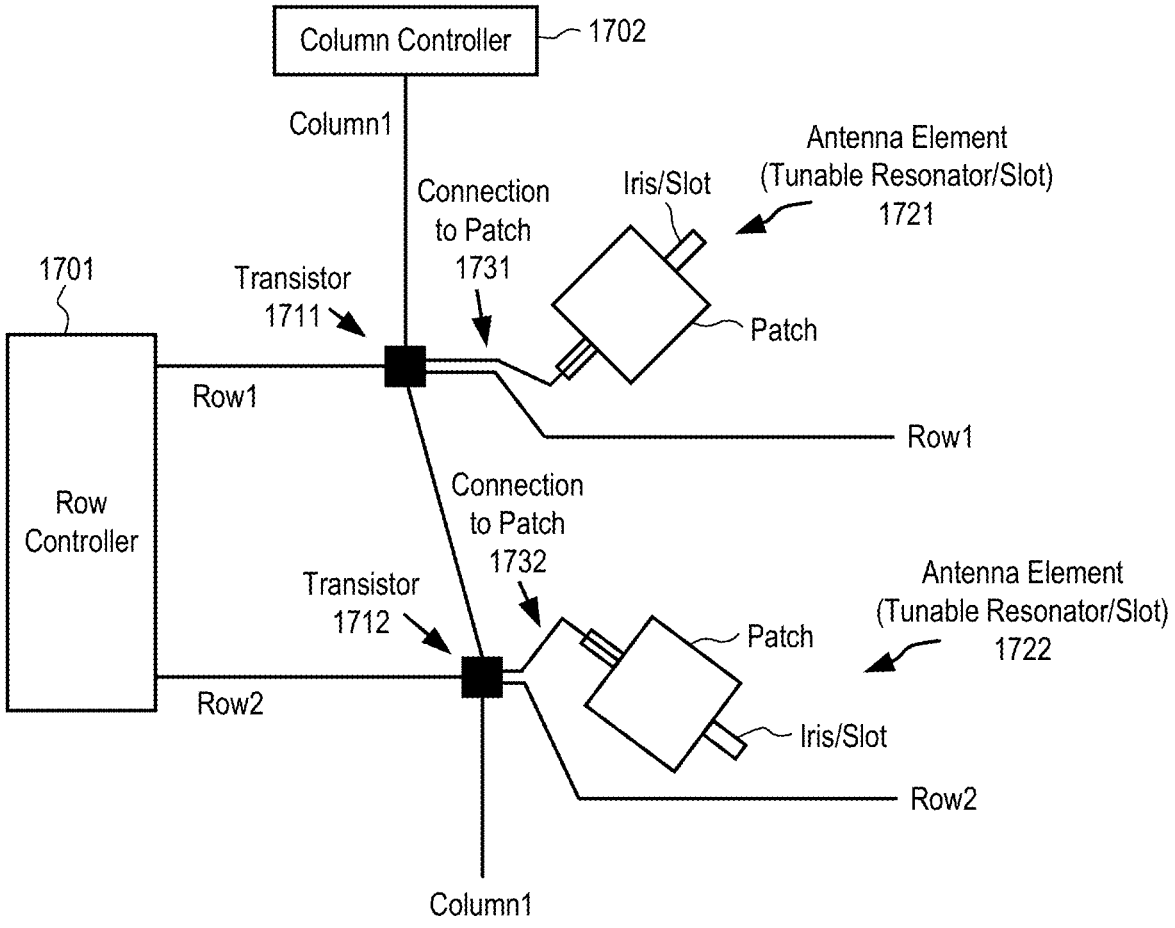
FIG. 12 illustrates one embodiment of the placement of matrix drive circuitry with respect to antenna elements.

In one embodiment, the antenna elements are placed on the cylindrical feed antenna aperture in a way that allows for a systematic matrix drive circuit. The placement of the cells includes placement of the transistors for the matrix drive. FIG. 12 illustrates one embodiment of the placement of matrix drive circuitry with respect to antenna elements. Referring to FIG. 12, row controller 1701 is coupled to transistors 1711 and 1712, via row select signals Row1 and Row2, respectively, and column controller 1702 is coupled to transistors 1711 and 1712 via column select signal Column1. Transistor 1711 is also coupled to antenna element 1721 via connection to patch 1731, while transistor 1712 is coupled to antenna element 1722 via connection to patch 1732.

In an initial approach to realize matrix drive circuitry on the cylindrical feed antenna with unit cells placed in a non-regular grid, two steps are performed. In the first step, the cells are placed on concentric rings and each of the cells is connected to a transistor that is placed beside the cell and acts as a switch to drive each cell separately. In the second step, the matrix drive circuitry is built in order to connect every transistor with a unique address as the matrix drive approach requires. Because the matrix drive circuit is built by row and column traces (similar to LCDs) but the cells are placed on rings, there is no systematic way to assign a unique address to each transistor. This mapping problem results in very complex circuitry to cover all the transistors and leads to a significant increase in the number of physical traces to accomplish the routing. Because of the high density of cells, those traces disturb the RF performance of the antenna due to coupling effect. Also, due to the complexity of traces and high packing density, the routing of the traces cannot be accomplished by commercially available layout tools.

In one embodiment, the matrix drive circuitry is predefined before the cells and transistors are placed. This ensures a minimum number of traces that are necessary to drive all the cells, each with a unique address. This strategy reduces the complexity of the drive circuitry and simplifies the routing, which subsequently improves the RF performance of the antenna.

More specifically, in one approach, in the first step, the cells are placed on a regular rectangular grid composed of rows and columns that describe the unique address of each cell. In the second step, the cells are grouped and transformed to concentric circles while maintaining their address and connection to the rows and columns as defined in the first step. A goal of this transformation is not only to put the cells on rings but also to keep the distance between cells and the distance between rings constant over the entire aperture. In order to accomplish this goal, there are several ways to group the cells.

Figure 13:
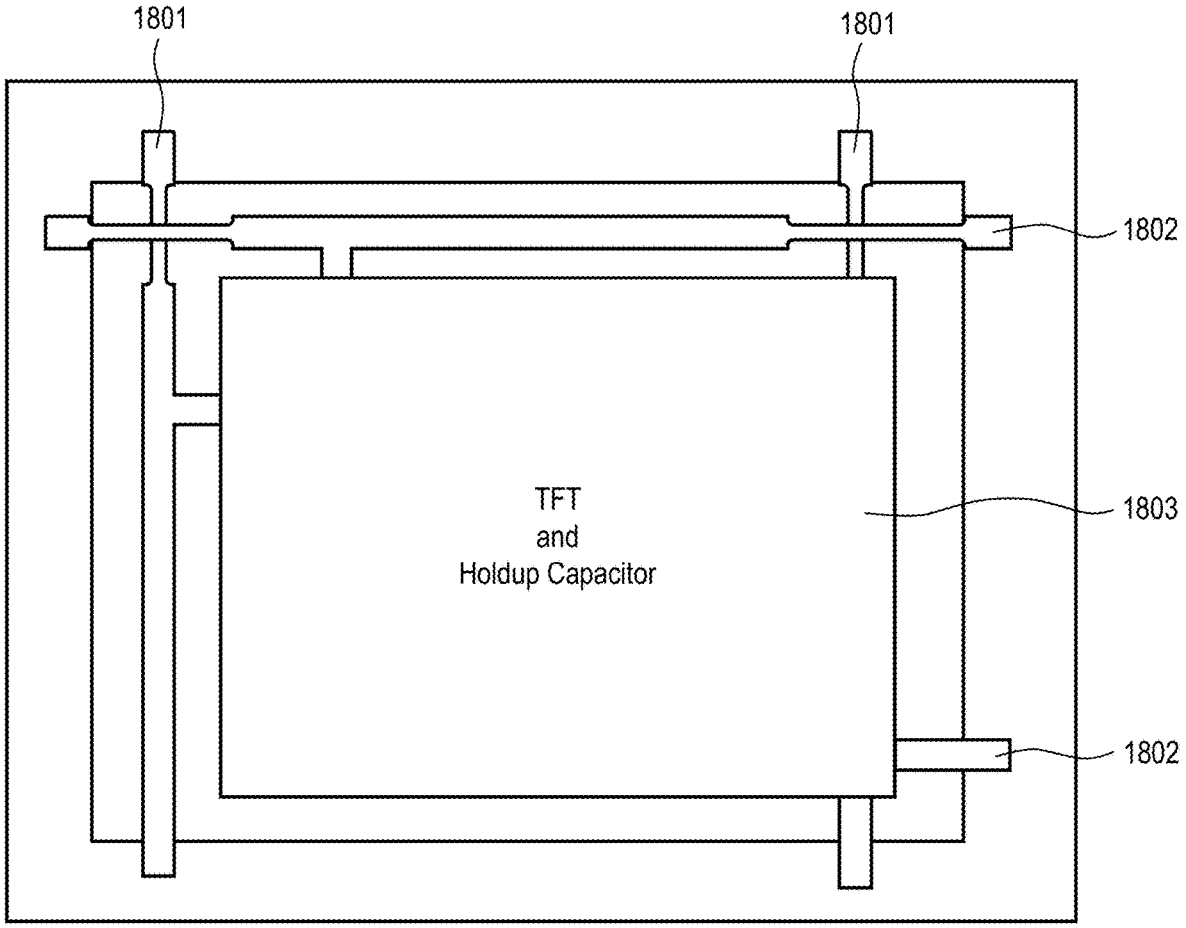
FIG. 13 illustrates one embodiment of a TFT package.

In one embodiment, a TFT package is used to enable placement and unique addressing in the matrix drive. FIG. 13 illustrates one embodiment of a TFT package. Referring to FIG. 13, a TFT and a hold capacitor 1803 is shown with input and output ports. There are two input ports connected to traces 1801 and two output ports connected to traces 1802 to connect the TFTs together using the rows and columns. In one embodiment, the row and column traces cross in 90° angles to reduce, and potentially minimize, the coupling between the row and column traces. In one embodiment, the row and column traces are on different layers.

An Example of a Full Duplex Communication System

Figure 14:
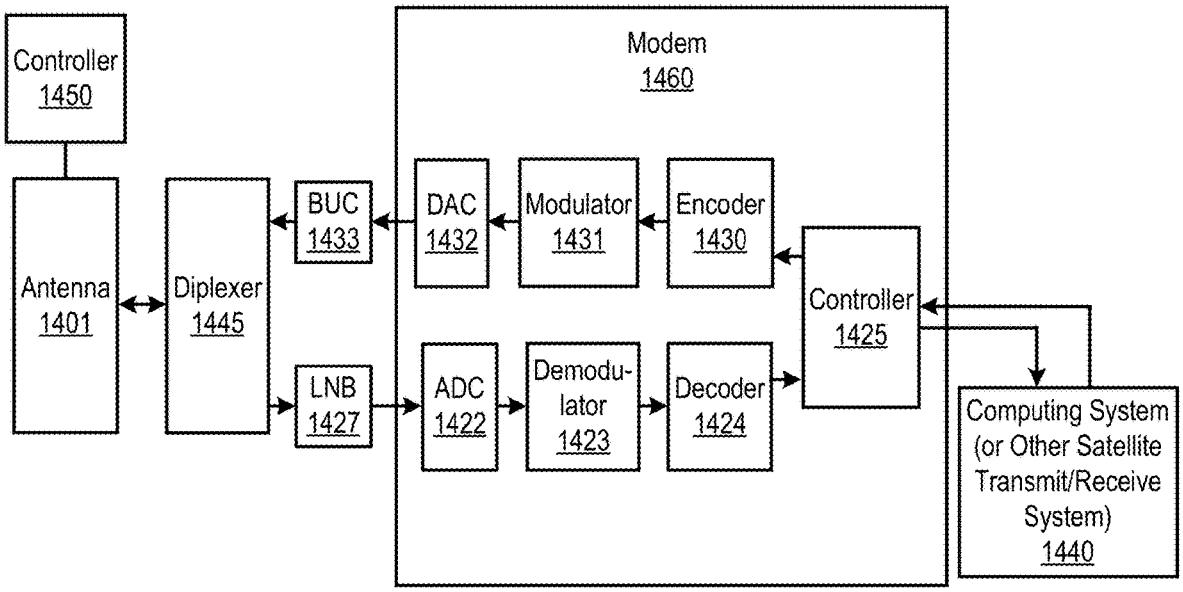
FIG. 14 is a block diagram of another embodiment of a communication system having simultaneous transmit and receive paths.

In another embodiment, the combined antenna apertures are used in a full duplex communication system. FIG. 14 is a block diagram of another embodiment of a communication system having simultaneous transmit and receive paths. While only one transmit path and one receive path are shown, the communication system may include more than one transmit path and/or more than one receive path.

Referring to FIG. 14, antenna 1401 includes two spatially interleaved antenna arrays operable independently to transmit and receive simultaneously at different frequencies as described above. In one embodiment, antenna 1401 is coupled to diplexer 1445. The coupling may be by one or more feeding networks. In one embodiment, in the case of a radial feed antenna, diplexer 1445 combines the two signals and the connection between antenna 1401 and diplexer 1445 is a single broad-band feeding network that can carry both frequencies.

Diplexer 1445 is coupled to a low noise block down converter (LNB) 1427, which performs a noise filtering function and a down conversion and amplification function in a manner well-known in the art. In one embodiment, LNB 1427 is in an out-door unit (ODU). In another embodiment, LNB 1427 is integrated into the antenna apparatus. LNB 1427 is coupled to a modem 1460, which is coupled to computing system 1440 (e.g., a computer system, modem, etc.).

Modem 1460 includes an analog-to-digital converter (ADC) 1422, which is coupled to LNB 1427, to convert the received signal output from diplexer 1445 into digital format. Once converted to digital format, the signal is demodulated by demodulator 1423 and decoded by decoder 1424 to obtain the encoded data on the received wave. The decoded data is then sent to controller 1425, which sends it to computing system 1440.

Modem 1460 also includes an encoder 1430 that encodes data to be transmitted from computing system 1440. The encoded data is modulated by modulator 1431 and then converted to analog by digital-to-analog converter (DAC) 1432. The analog signal is then filtered by a BUC (up-convert and high pass amplifier) 1433 and provided to one port of diplexer 1445. In one embodiment, BUC 1433 is in an out-door unit (ODU).

Diplexer 1445 operating in a manner well-known in the art provides the transmit signal to antenna 1401 for transmission.

Controller 1450 controls antenna 1401, including the two arrays of antenna elements on the single combined physical aperture.

The communication system would be modified to include the combiner/arbiter described above. In such a case, the combiner/arbiter after the modem but before the BUC and LNB.

Note that the full duplex communication system shown in FIG. 14 has a number of applications, including but not limited to, internet communication, vehicle communication (including software updating), etc.

There is a number of example embodiments described herein.

Example 1 is an antenna comprising: an aperture having a plurality of antenna elements operable to radiating radio-frequency (RF) energy; and a single-layer wide angle impedance matching (WAIM) structure coupled to the aperture to provide impedance matching between the antenna aperture and free space.

Example 2 is the antenna of example 1 that may optionally include that the single-layer WAIM structure comprises a capacitive impedance surface with a two-dimensional (2D) array of sub-wavelength elements.

Example 3 is the antenna of example 2 that may optionally include that the sub-wavelength elements comprises a 2D array of capacitive patches.

Example 4 is the antenna of example 3 that may optionally include that the capacitive patches are square-shaped patches.

Example 5 is the antenna of example 3 that may optionally include that the capacitive patches are hexagonal-shaped patches.

Example 6 is the antenna of example 2 that may optionally include that the sub-wavelength elements are split-ring resonators or dipoles.

Example 7 is the antenna of example 1 that may optionally include that the single-layer WAIM structure comprises a substrate and the sub-wavelength elements of the single-layer WAIM structure are screen printed on the substrate.

Example 8 is the antenna of example 1 that may optionally include that the single-layer WAIM structure is separated from the aperture by at least a dielectric spacer.

Example 9 is the antenna of example 8 that may optionally include that impedance of the single-layer WAIM structure is based on physical dimensions of its features and its surrounding medium.

Example 10 is the antenna of example 1 that may optionally include that impedance of the single-layer WAIM structure is a function of scan angle and polarization of a propagating wave and is independent of a scan plane of the antenna.

Example 11 is the antenna of example 1 that may optionally include that the single-layer WAIM structure has rotational symmetry.

Example 12 is the antenna of example 1 the aperture comprises a metasurface.

Example 13 is an antenna comprising: a metasurface having a plurality of antenna elements operable to radiating radio-frequency (RF) energy; and a single-layer wide angle impedance matching (WAIM) structure coupled to the aperture to provide impedance matching between the antenna aperture and free space, the single-layer WAIM structure having a capacitive impedance surface with a two-dimensional (2D) array of sub-wavelength elements.

Example 14 is the antenna of example 13 that may optionally include that the sub-wavelength elements comprises a 2D array of capacitive patches.

Example 15 is the antenna of example 14 that may optionally include that the capacitive patches are square-shaped patches or hexagonal-shaped patches.

Example 16 is the antenna of example 13 that may optionally include that the sub-wavelength elements are split-ring resonators or dipoles.

Example 17 is the antenna of example 13 that may optionally include that the single-layer WAIM structure comprises a substrate and the sub-wavelength elements of the single-layer WAIM structure are screen printed on the substrate.

Example 18 is the antenna of example 13 that may optionally include that the single-layer WAIM structure is separated from the aperture by at least a dielectric spacer.

Example 19 is the antenna of example 18 that may optionally include that impedance of the single-layer WAIM structure is based on physical dimensions of its features and its surrounding medium.

Example 20 is the antenna of example 13 that may optionally include that impedance of the single-layer WAIM structure is a function of scan angle and polarization of a propagating wave and is independent of a scan plane of the antenna.

Example 21 is an antenna comprising: a metasurface having a plurality of antenna elements operable to radiating radio-frequency (RF) energy; a dielectric layer coupled to the metasurface; and a single-layer wide angle impedance matching (WAIM) structure coupled to the dielectric layer to provide impedance matching between the antenna aperture and free space, wherein single-layer WAIM structure comprise a substrate with a two-dimensional (2D) array of capacitive elements screen printed thereon.

Some portions of the detailed descriptions above are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The present invention also relates to apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but is not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, and each coupled to a computer system bus.

The algorithms and displays presented herein are not inherently related to any particular computer or other apparatus. Various general-purpose systems may be used with programs in accordance with the teachings herein, or it may prove convenient to construct more specialized apparatus to perform the required method steps. The required structure for a variety of these systems will appear from the description below. In addition, the present invention is not described with reference to any particular programming language. It will be appreciated that a variety of programming languages may be used to implement the teachings of the invention as described herein.

A machine-readable medium includes any mechanism for storing or transmitting information in a form readable by a machine (e.g., a computer). For example, a machine-readable medium includes read only memory ("ROM"); random access memory ("RAM"); magnetic disk storage media; optical storage media; flash memory devices; etc.

Whereas many alterations and modifications of the present invention will no doubt become apparent to a person of ordinary skill in the art after having read the foregoing description, it is to be understood that any particular embodiment shown and described by way of illustration is in no way intended to be considered limiting. Therefore, references to details of various embodiments are not intended to limit the scope of the claims which in themselves recite only those features regarded as essential to the invention.

We claim:

1. An antenna comprising:

an aperture having a plurality of antenna elements operable to radiating radio-frequency (RF) energy; and a single-layer wide angle impedance matching (WAIM) structure coupled to and separate from the plurality of antenna elements of the aperture to provide impedance matching between the antenna aperture and free space, wherein the single-layer WAIM structure comprises a capacitive impedance surface with a two-dimensional (2D) array of sub-wavelength elements that comprises a 2D array of capacitive pieces of material.

2. The antenna of claim 1 wherein the 2D array of capacitive pieces of material comprises a 2D array of capacitive patches.

3. The antenna of claim 2 wherein the capacitive patches are square-shaped patches.

4. The antenna of claim 2 wherein the capacitive patches are hexagonal-shaped patches.

5. The antenna of claim 1 wherein the single-layer WAIM structure comprises a substrate and the sub-wavelength elements of the single-layer WAIM structure are screen printed on the substrate.

6. The antenna of claim 1 wherein the single-layer WAIM structure is separated from the aperture by at least a dielectric spacer.

7. The antenna of claim 6 wherein impedance of the single-layer WAIM structure is based on physical dimensions of its features and its surrounding medium.

8. The antenna of claim 1 wherein impedance of the single-layer WAIM structure is a function of scan angle and polarization of a propagating wave and is independent of a scan plane of the antenna.

9. The antenna of claim 1 wherein the single-layer WAIM structure has rotational symmetry.

10. The antenna of claim 1 wherein the aperture comprises a metasurface.

11. An antenna comprising:

a metasurface having a plurality of antenna elements operable to radiating radio- frequency (RF) energy; and a single-layer wide angle impedance matching (WAIM) structure coupled to the aperture to provide impedance matching between the antenna aperture and free space, the single-layer WAIM structure having a capacitive impedance surface with a two-dimensional (2D) array of sub-wavelength elements, wherein impedance of the single-layer WAIM structure is a function of scan angle and polarization of a propagating wave and is independent of a scan plane of the antenna.

12. The antenna of claim 11 wherein the sub-wavelength elements comprises a 2D array of capacitive patches.

13. The antenna of claim 12 wherein the capacitive patches are square-shaped patches or hexagonal-shaped patches.

14. The antenna of claim 11 wherein the sub-wavelength elements are split-ring resonators or dipoles.

15. The antenna of claim 11 wherein the single-layer WAIM structure comprises a substrate and the sub-wavelength elements of the single-layer WAIM structure are screen printed on the substrate.

16. The antenna of claim 11 wherein the single-layer WAIM structure is separated from the aperture by at least a dielectric spacer.

17. The antenna of claim 16 wherein impedance of the single-layer WAIM structure is based on physical dimensions of its features and its surrounding medium.

18. An antenna comprising:

a metasurface having a plurality of antenna elements operable to radiating radio- frequency (RF) energy;

a dielectric layer coupled to the metasurface; and a single-layer wide angle impedance matching (WAIM) structure coupled to the dielectric layer to provide impedance matching between the antenna aperture and free space, wherein single-layer WAIM structure comprise a substrate with a two-dimensional (2D) array of capacitive elements screen printed thereon, wherein impedance of the single-layer WAIM structure is a function of scan angle and polarization of a propagating wave and is independent of a scan plane of the antenna.

* * * * *